US010947475B2

(12) United States Patent
Onodera et al.

(10) Patent No.: US 10,947,475 B2
(45) Date of Patent: Mar. 16, 2021

(54) LUBRICATING OIL COMPOSITION

(71) Applicants: EXXONMOBIL RESEARCH AND ENGINEERING COMPANY, Annandale, NJ (US); TOYOTA JIDOSHA KABUSHIKI KAISHA, Toyota (JP)

(72) Inventors: Ko Onodera, Kawasaki (JP); Shuzo Nemoto, Kawasaki (JP); Tomohiro Kato, Kawasaki (JP); Kosuke Fujimoto, Toyota (JP); Minoru Yamashita, Okazaki (JP)

(73) Assignees: EXXONMOBIL RESEARCH AND ENGINEERING COMPANY, Annandale, NJ (US); TOYOTA JIDOSHA KABUSHIKI KAISHA, Toyota (JP)

( * ) Notice: Subject to any disclaimer, the term of this patent is extended or adjusted under 35 U.S.C. 154(b) by 506 days.

(21) Appl. No.: 15/115,766

(22) PCT Filed: Nov. 20, 2014

(86) PCT No.: PCT/JP2014/080756
§ 371 (c)(1),
(2) Date: Aug. 1, 2016

(87) PCT Pub. No.: WO2015/114920
PCT Pub. Date: Aug. 6, 2015

(65) Prior Publication Data

US 2017/0022441 A1 Jan. 26, 2017

(30) Foreign Application Priority Data

Jan. 31, 2014 (JP) ..... JP2014-016331
Sep. 1, 2014 (JP) ..... JP2014-177254

(51) Int. Cl.
*C10M 141/12* (2006.01)
*C10N 10/04* (2006.01)
(Continued)

(52) U.S. Cl.
CPC .. *C10M 141/12* (2013.01); *C10M 2203/1025* (2013.01); *C10M 2205/02* (2013.01);
(Continued)

(58) Field of Classification Search
CPC ..... C10N 2210/02; C10N 2210/06; C10N 2230/04; C10N 2230/40
(Continued)

(56) References Cited

U.S. PATENT DOCUMENTS 6,004,910 A * 12/1999 Bloch ..... C10M 163/00 508/294
7,737,092 B2 * 6/2010 Ward, Jr. ..... C10M 163/00 508/162
(Continued)

FOREIGN PATENT DOCUMENTS

EP 2 133 406 A1 12/2009
JP 2006-328265 A 12/2006
(Continued)

OTHER PUBLICATIONS

Kosuke Fujimoto et al. "Investigations of Engine Oil Effect on Abnormal Combustion in Turbocharged Direct Injection—Spark Ignition Engines (Second Report)—Correlation Between Auto-Ignition Temperature of Engine Oil and Low-Speed Pre-Ignition Frequency". Society of Automotive Engineers of Japan, Inc., Collection of Technical Symposium Papers, No. 70-12, pp. 5-8 (May 25, 2012, Society of Automotive Engineers of Japan, Annual Spring Conference).
(Continued)

*Primary Examiner* — Ellen M McAvoy
(74) *Attorney, Agent, or Firm* — Oliff PLC

(57) ABSTRACT

A lubricating oil composition which can reduce the occurrence frequency of LSPI and which can ensure detergency. The lubricating oil composition which includes a lubricant base oil, a compound having calcium and/or magnesium, a compound having molybdenum and/or phosphorus, and an ashless dispersant having nitrogen and which satisfies $X \leq -0.85$ and $Y \geq 0.18$ (wherein X is calculated according to formula (1): $X=([Ca]+0.5[Mg])\times 8-[Mo]\times 8-[P]\times 30$ and Y is calculated according to formula (2): $Y=[Ca]+1.65[Mg]+[N]$). The lubricating oil composition for use in an internal combustion engine, more particularly, a lubricating oil composition for use in a supercharged gasoline engine.

9 Claims, 1 Drawing Sheet

(51) Int. Cl.

| | |
|---|---|
| *C10N 10/12* | (2006.01) |
| *C10N 20/02* | (2006.01) |
| *C10N 20/04* | (2006.01) |
| *C10N 30/04* | (2006.01) |
| *C10N 30/12* | (2006.01) |
| *C10N 30/00* | (2006.01) |
| *C10N 40/25* | (2006.01) |

(52) U.S. Cl.

CPC ..... *C10M 2205/0285* (2013.01); *C10M 2207/028* (2013.01); *C10M 2207/262* (2013.01); *C10M 2209/084* (2013.01); *C10M 2215/28* (2013.01); *C10M 2215/30* (2013.01); *C10M 2219/046* (2013.01); *C10M 2219/068* (2013.01); *C10M 2223/045* (2013.01); *C10M 2227/066* (2013.01); *C10N 2010/04* (2013.01); *C10N 2010/12* (2013.01); *C10N 2020/02* (2013.01); *C10N 2020/04* (2013.01); *C10N 2030/04* (2013.01); *C10N 2030/12* (2013.01); *C10N 2030/40* (2020.05); *C10N 2030/42* (2020.05); *C10N 2040/25* (2013.01); *C10N 2040/255* (2020.05)

(58) Field of Classification Search

USPC ..... 508/185–192

See application file for complete search history.

(56) References Cited

U.S. PATENT DOCUMENTS

| | | | | |
|---|---|---|---|---|
| 7,767,633 | B2 * | 8/2010 | van Dam | C10M 163/00 508/273 |
| 7,820,599 | B2 * | 10/2010 | Kasai | C10M 163/00 508/192 |
| 7,906,469 | B2 * | 3/2011 | Arrowsmith | C10M 163/00 508/363 |
| 7,981,846 | B2 * | 7/2011 | Boffa | C10M 159/24 508/155 |
| 8,076,274 | B2 * | 12/2011 | Scott | C10M 163/00 508/154 |
| 8,709,988 | B2 * | 4/2014 | Arrowsmith | C10M 163/00 508/165 |
| 9,347,019 | B2 * | 5/2016 | Shaw | C10M 169/04 |
| 2007/0111904 | A1 * | 5/2007 | Van Dam | C10M 163/00 508/273 |
| 2008/0020955 | A1 * | 1/2008 | Diggs | C10M 163/00 508/391 |
| 2008/0139430 | A1 * | 6/2008 | Lam | C10M 159/24 508/391 |
| 2009/0082233 | A1 | 3/2009 | Kasai | |
| 2011/0237474 | A1 * | 9/2011 | Mazzamaro | C10M 141/08 508/364 |
| 2011/0245120 | A1 | 10/2011 | Bertram et al. | |
| 2013/0005622 | A1 * | 1/2013 | Lyon | C10M 171/02 508/192 |
| 2015/0045271 | A1 | 2/2015 | Yoshida | |
| 2016/0024416 | A1 * | 1/2016 | Kamano | C10M 141/08 508/192 |

FOREIGN PATENT DOCUMENTS

| | | | |
|---|---|---|---|
| JP | 2011-012213 | A | 1/2011 |
| JP | 2011-184566 | A | 9/2011 |
| JP | 2011-214004 | A | 10/2011 |
| JP | 2013-199594 | A | 10/2013 |
| JP | 2014-152301 | A | 8/2014 |

OTHER PUBLICATIONS

Satoshi Hirano et al. "Investigation of Engine Oil Effect on Abnormal Combustion in Turbocharged Direct Injection—Spark Ignition Engines (Part 3)". Society of Automotive Engineers of Japan, Inc., Collection of Technical Symposium Papers, No. 12-13, pp. 11-14 (May 22, 2013, Society of Automotive Engineers of Japan, Annual Spring Conference).

Nov. 25, 2016 Search Report issued in European Patent Application No. 14880952.8.

Akram Zahdeh et al. "Fundamental Approach to Investigate Pre-Ignition in Boosted SI Engines". SAE International Journal of Engines, vol. 4, No. 1, Apr. 12, 2011, pp. 246-273.

Kazuo Takeuchi et al. "Investigation of Engine Oil Effect on Abnormal Combustion in Turbocharged Direct Injection—Spark Ignition Engines". SAE International Journal of Fuels and Lubricants, vol. 5, No. 3, Jan. 30, 2012, pp. 1017-1024.

Kazuo Takeuchi et al. "Investigations of Engine Oil Effect on Abnormal Combustion in Turbocharged Direct Injection—Spark Ignition Engines (Part 1)—Preventing or Contributing to Low-Speed Pre-Ignition Through Effects of Engine Oil Additives". May 25, 2012, pp. 1-4.

* cited by examiner

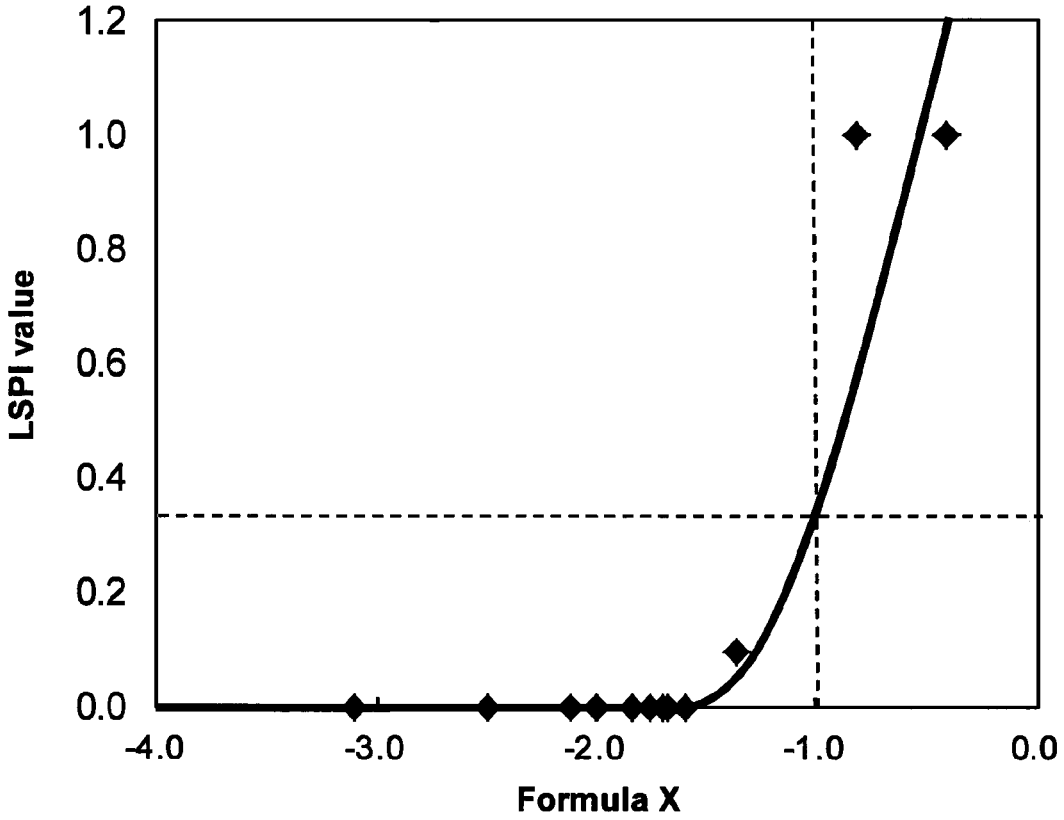
1.2
1.0
0.8
0.6
0.4
0.2
0.0
LSPI value
-4.0
-3.0
-2.0
-1.0
0.0
Formula X

LUBRICATING OIL COMPOSITION

TECHNICAL FIELD

The present invention relates to a lubricating oil composition, more particularly to a lubricating oil composition for an internal combustion engine, and even more particularly, to a lubricating oil composition for a supercharged gasoline engine.

BACKGROUND ART

Various requirements such as reduced size, higher output, better fuel consumption and accommodation of emissions standards have been placed on internal combustion engines in recent years, and various studies have been conducted on lubricating oil compositions for use in internal combustion engines for the purpose of improving fuel savings (Patent Documents 1 and 2).

In addition, supercharged, direct fuel-injected engines are continuing to be introduced in order to improve fuel consumption of gasoline engine vehicles. The introduction of supercharged, direct fuel-injected engines makes it possible to increase torque at low rpm and lower displacement while maintaining the same output. Consequently, fuel consumption can be improved and the proportion of mechanical loss can be reduced. On the other hand, in supercharged, direct fuel-injected engines, the problem of sudden abnormal combustion in the form of low speed pre-ignition (LSPI) occurs when torque at low rpm is increased. The occurrence of LSPI places limitations on improvement of fuel consumption while also causing an increase in mechanical loss.

Engine oil is blended with various additives such as wear inhibitors, metal cleaners, ashless dispersants or antioxidants in order to satisfy various performance requirements. Non-Patent Documents 1 to 3 describe that these additives have an effect on the occurrence of LSPI. For example, Non-Patent Document 2 describes that calcium in an additive promotes the occurrence of LSPI while molybdenum and phosphorous inhibit the occurrence of LSPI. Non-Patent Document 2 describes that the frequency of occurrence of LSPI varies according to the type of base oil and presence or absence of metal cleaner. Non-Patent Document 3 describes that the effects of the presence of calcium, phosphorous and molybdenum in additives, as well as the presence of iron and copper eluted due to engine wear, have an effect on the frequency of occurrence of LSPI, and that the frequency of occurrence of LSPI increases accompanying deterioration of engine oil.

PRIOR ART DOCUMENTS

Patent Documents

Patent Document 1: Japanese Unexamined Patent Publication No. 2011-184566

Patent Document 2: Japanese Unexamined Patent Publication No. 2013-199594

Non-Patent Documents

Non-Patent Document 1: Takeuchi, K. et al.: "Survey of the Effects of Engine Oil Ignitability on Abnormal Combustion in Supercharged, Direct Fuel-Injected Engines (Report No. 1)—Low speed pre-ignition inhibitory and promoting effects of engine oil additives", Society of Automotive Engineers of Japan, Inc., Collection of Technical Symposium Papers, No. 70-12, pp. 1-4 (May 25, 2012, Society of Automotive Engineers of Japan, Annual Spring Conference)

Non-Patent Document 2: Fujimoto, K. et al.: "Survey of the Effects of Engine Oil Ignitability on Abnormal Combustion in Supercharged, Direct Fuel-Injected Engines (Report No. 2)—Oil Auto-ignition temperature and frequency of low speed pre-ignition", Society of Automotive Engineers of Japan, Inc., Collection of Technical Symposium Papers, No. 70-12, pp. 5-8 (May 25, 2012, Society of Automotive Engineers of Japan, Annual Spring Conference)

Non-Patent Document 3: Hirano, S. et al.: "Survey of the Effects of Engine Oil Ignitability on Abnormal Combustion in Supercharged, Direct Fuel-Injected Engines (Report No. 2)", Society of Automotive Engineers of Japan, Inc., Collection of Technical Symposium Papers, No. 12-13, pp. 11-14 (May 22, 2013, Society of Automotive Engineers of Japan, Annual Spring Conference)

DISCLOSURE OF THE INVENTION

Problems to be Solved by the Invention

Examples of performance required of the aforementioned engine oil include cleaning performance, rust prevention, dispersibility, oxidation prevention and wear resistance. It is necessary to suitably design additives to obtain performance in these areas. For example, metal cleaner containing calcium is blended in order to obtain cleaning performance and rust prevention. If the amount of calcium-containing metal cleaner is reduced in order to reduce the frequency of occurrence of LSPI as previously described, there is the problem of being unable to ensure the cleaning performance and rust prevention of the engine oil. In addition, although examples of additives containing molybdenum include molybdenum-containing friction modifiers and phosphorous-containing wear inhibitors, there is the risk of these additives breaking down at high temperatures resulting in the formation of deposits. Consequently, if the amount of molybdenum-containing friction modifier or phosphorous-containing wear inhibitor is increased in order to reduce the frequency of occurrence of LSPI, there is the problem of a resulting decrease in high-temperature cleaning performance. Namely, technology for preventing LSPI and technology for ensuring performance required by engine oil (and particularly, cleaning performance and rust prevention) may be offsetting, and a technology is therefore required that allows both of these to be achieved.

With the foregoing in view, a first object of the present invention is to provide a lubricating oil composition capable of lowering the frequency of occurrence of LSPI and ensuring cleaning performance.

As a result of conducting extensive studies to solve the aforementioned first problem, the inventors of the present invention found that, by enabling the amount of calcium, magnesium, molybdenum and phosphorous contained in a lubricating oil composition to satisfy a specific relational expression, and enabling the amounts of calcium and magnesium and the amount of nitrogen derived from ashless dispersant contained in a lubricating oil composition to satisfy a specific relational expression, the frequency of occurrence of LSPI can be decreased and cleaning performance can be ensured, thereby leading to completion of the present invention.

Namely, in a first aspect thereof, the present invention relates to a lubricating oil composition comprising a lubricating oil base oil, a compound having at least one type of element selected from calcium and magnesium, a compound having at least one type of element selected from molybdenum and phosphorous, and an ashless dispersant having nitrogen; wherein, X as determined from the following equation (1):

$$X=([Ca]+0.5[Mg])\times 8-[Mo]\times 8-[P]\times 30 \quad (1)$$

(wherein, [Ca], [Mg], [Mo] and [P] in equation (1) respectively represent the concentrations (wt %) of calcium, magnesium, molybdenum and phosphorous in the lubricating oil composition)

satisfies the expression $X\leq -0.85$; and,

Y as determined from the following equation (2):

$$Y=[Ca]+1.65[Mg]+[N] \quad (2)$$

(wherein, [Ca], [Mg] and [N] in equation (2) respectively represent the concentrations (wt) of calcium, magnesium and nitrogen derived from ashless dispersant in the lubricating oil composition)

satisfies the expression $Y\geq 0.18$.

In addition, as was previously described, if the amount of calcium-based metal cleaner in a lubricating oil composition is reduced in order to lower the frequency of occurrence of LSPI, adequate rust prevention is unable to be ensured for the lubricating oil composition. Therefore, a second object of the present invention is to provide a lubricating oil composition capable of lowering the frequency of occurrence of LSPI and ensuring rust prevention.

As a result of conducting extensive studies to solve the aforementioned second problem, the inventors of the present invention found that, by enabling the amounts of magnesium and calcium contained in the lubricating oil composition to satisfy a specific relational expression, the frequency of occurrence of LSPI can be lowered and rust prevention can be ensured. Namely, in a second aspect thereof, the present invention relates to a lubricating oil composition comprising a lubricating oil base oil, a compound having at least one type of compound having magnesium, and optionally at least one type of compound having calcium; wherein, Q as determined from the following equation (4):

$$Q=[Ca]+0.05[Mg] \quad (4)$$

(wherein, [Ca] and [Mg] in equation (4) respectively represent the concentrations (wt %) of calcium and magnesium in the lubricating oil composition)

satisfies the expression $Q\leq 0.15$; and,

W as determined from the following equation (5):

$$W=[Ca]+1.65[Mg] \quad (5)$$

(wherein, [Ca] and [Mg] in equation (5) respectively represent the concentrations (wt %) of calcium and magnesium in the lubricating oil composition)

satisfies the expression $0.14\leq W\leq 1.0$.

Moreover, the aforementioned second invention relates to a lubricating oil composition comprising a lubricating oil base oil, at least one type of compound having magnesium and at least one type of compound having calcium; wherein, Q as determined from the aforementioned equation (4) satisfies the expression $Q\leq 0.15$ and W as determined from the aforementioned equation (5) satisfies the expression $0.14\leq W\leq 1.0$.

In addition, the present invention relates to a lubricating oil composition comprising a lubricating oil base oil, at least one type of compound having magnesium, a compound having at least one type of element selected from molybdenum and phosphorous, an ashless dispersant having nitrogen, and optionally, at least one type of compound having calcium; wherein, X as determined from the following equation (1):

$$X=([Ca]+0.5[Mg])\times 8-[Mo]\times 8-[P]\times 30 \quad (1)$$

(wherein, [Ca], [Mg], [Mo] and [P] in equation (1) respectively represent the concentrations (wt %) of calcium, magnesium, molybdenum and phosphorous in the lubricating oil composition)

satisfies the expression $X\leq -0.85$;

Y as determined from the following equation (2):

$$Y=[Ca]+1.65[Mg]+[N] \quad (2)$$

(wherein, [Ca], [Mg] and [N] in equation (2) respectively represent the concentrations (wt %) of calcium, magnesium and nitrogen derived from ashless dispersant in the lubricating oil composition)

satisfies the expression $Y\geq 0.18$;

Q as determined from the following equation (4):

$$Q=[Ca]+0.05[Mg] \quad (4)$$

(wherein, [Ca] and [Mg] in equation (4) respectively represent the concentrations (wt %) of calcium and magnesium in the lubricating oil composition)

satisfies the expression $Q\leq 0.15$; and,

W as determined from the following equation (5):

$$W=[Ca]+1.65[Mg] \quad (5)$$

(wherein, [Ca] and [Mg] in equation (5) respectively represent the concentrations (wt %) of calcium and magnesium in the lubricating oil composition) satisfies the expression $0.14\leq W\leq 1.0$.

Each of the aforementioned lubricating oil compositions of the present invention particularly relates to a lubricating oil composition for an internal combustion engine, and more particularly, to a lubricating oil composition for a supercharged, direct fuel-injected gasoline engine.

Effects of the Invention

The lubricating oil composition that satisfies the requirements of the aforementioned first invention is capable of lowering the frequency of occurrence of LSPI and ensuring high-temperature cleaning performance. In addition, the lubricating oil composition that satisfies the requirements of the aforementioned second invention is capable of lowering the frequency of occurrence of LSPI and ensuring rust prevention. Moreover, a lubricating oil composition that satisfies the requirements of the aforementioned first invention and second invention is capable of lowering the frequency of occurrence of LSPI, ensuring cleaning performance and ensuring rust prevention. Each of the aforementioned lubricating oil compositions of the present invention can be particularly preferably used as a lubricating oil composition for an internal combustion engine, and more particularly, can be preferably used as a lubricating oil composition for a supercharged, direct fuel-injected engine. In addition, each of the lubricating oil compositions of the present invention is also preferable as a low viscosity grade lubricating oil. More specifically, each of the lubricating oil compositions of the present invention is preferable as 0W-20/5W-20 or 0W-16/5W-16 low viscosity grade lubricating oil or as lubricating oil having even lower viscosity.

BRIEF DESCRIPTION OF THE DRAWINGS

FIG. 1 is a drawing showing the relationship between the value of X as determined from equation (1) and the frequency of occurrence of LSPI.

BEST MEANS FOR SOLVING THE PROBLEMS

In a first aspect thereof, the present invention is able to provide a lubricating oil composition capable of lowering the frequency of occurrence of LSPI and ensuring cleaning performance. This first invention is a lubricating oil composition comprising a lubricating oil base oil, a compound having at least one type of element selected from calcium and magnesium, a compound having at least one type of element selected from molybdenum and phosphorous, and an ashless dispersant having nitrogen. In the first invention, the lubricating oil composition is characterized in that the concentrations of calcium, magnesium, nitrogen derived from an ashless dispersant, molybdenum and phosphorous are such that X indicated in the aforementioned equation (1) and Y indicated in the aforementioned equation (2) satisfy the aforementioned specified ranges. The following provides a detailed explanation of equation (1) and equation (2).

The aforementioned equation (1) is an equation indicating the relationship of the concentrations of calcium, magnesium, molybdenum and phosphorous in the lubricating oil composition. In the aforementioned equation (1), [Ca], [Mg], [Mo] and [P] respectively represent the concentrations (wt) of calcium, magnesium, molybdenum and phosphorous in the lubricating oil composition. The occurrence of LSPI can be effectively inhibited by making the concentrations of calcium, magnesium, molybdenum and phosphorous contained in the lubricating oil composition to be within a range such that X indicated in the aforementioned equation (1) satisfies the expression $X \leq -0.85$.

The aforementioned equation (1) is an equation determined from the correlation between the frequency of occurrence of LSPI and the concentrations of calcium, magnesium, molybdenum and phosphorous in the lubricating oil composition. In equation (1), calcium and magnesium have a negative effect on prevention of LSPI, while molybdenum and phosphorous have a positive effect on prevention of LSPI. In equation (1), the numbers 8, 8 and 30 are the result of quantifying the degree of contribution of each element. The preferable range of X is less than −0.85, more preferably −1 or less, more preferably less than −1, even more preferably −1.2 or less and most preferably −1.68 or less. Although there are no limitations on the lower limit value of X, it is preferably −5.0 or more, more preferably −3.0 or more and most preferably −2.4 or more. If X is below the aforementioned lower limit value, problems may occur such as poor high-temperature cleaning performance or detrimental effects on the exhaust gas post-treatment device. In addition, the coefficient of [Mo] in equation (1) is 0.5. This value was set since LSPI preventive effects vary for each element. The relationship between the value X as determined in the aforementioned equation (1) and the frequency of occurrence of LSPI is shown in FIG. 1. As shown in FIG. 1, the occurrence of LSPI can be effectively inhibited if the value of X determined in equation (1) is equal to or lower than the aforementioned lower limit value.

The aforementioned equation (1) becomes as shown with the following equation (1') in the case the lubricating oil composition contains magnesium but does not contain calcium:

$$X'=0.5[Mg]\times 8-[Mo]\times 8-[P]\times 30 \quad (1')$$

(wherein, [Mg], [Mo] and [P] in equation (1') respectively represent the concentrations (wt %) of magnesium, molybdenum and phosphorous in the lubricating oil composition). The occurrence of LSPI can be effectively inhibited by enabling the value of X' as determined in the aforementioned equation (1') to satisfy the expression $X' - 0.85$.

In addition, the aforementioned equation (1') becomes as shown with the following equation (1") in the case the lubricating oil composition contains calcium but does not contain magnesium:

$$X''=[Ca]\times 8-[Mo]\times 8-[P]\times 30 \quad (1'')$$

(wherein, [Ca], [Mo] and [P] in equation (1") respectively represent the concentrations (wt %) of calcium, molybdenum and phosphorous in the lubricating oil composition). The occurrence of LSPI can be effectively inhibited by enabling the value of X" determined in the aforementioned equation (1") to satisfy the expression $X'' \leq -0.85$.

The aforementioned equation (2) indicates that the total amount of a compound having at least one type of element selected from calcium and magnesium and an ashless dispersant having nitrogen in the lubricating oil composition is required to be equal to or greater than a specific amount. In the aforementioned equation (2), [Ca] and [Mg] are the contents (wt %) of calcium and magnesium in the lubricating oil composition, while [N] is the content (wt %) of nitrogen derived from an ashless dispersant in the lubricating oil composition. In the present invention, the contents of calcium and magnesium (wt %) and the content of nitrogen derived from an ashless dispersant in the lubricating oil composition are amounts such that Y indicated in the aforementioned equation (2) satisfies the expression $Y \geq 0.18$. Y is preferably 0.19 or more and more preferably 0.21 or more. If Y is equal to or greater than the aforementioned lower limit value, cleaning performance of the lubricating oil composition can be ensured while lowering the frequency of occurrence of LSPI. Cleaning performance becomes inadequate if Y is less than the aforementioned lower limit value. Although there are no limitations on the upper limit value of Y, it is preferably 1.0 or less, more preferably 0.8 or less and most preferably 0.5 or less. If Y exceeds the aforementioned upper limit value, although cleaning performance improves, cleaning effects corresponding to the added amount are not obtained, while increases in the amount of additive causes poor viscosity characteristics, which may result in the problem of having a detrimental effect on fuel consumption.

The coefficient of [Mg] in the aforementioned formula (2) is 1.65. This was set since the effects of improving cleaning performance of a metal cleaner of calcium or magnesium are proportional to the number of atoms (namely, number of moles) of that element. Since the atomic weight of magnesium is 1/1.65 the atomic weight of calcium, this means that calcium demonstrates 1.65 times the effect of improving cleaning performance for the same mass.

The aforementioned equation (2) becomes as shown with the following equation (2') in the case the lubricating oil composition contains magnesium but does not contain calcium:

$$Y'=1.65[Mg]+[N] \quad (2')$$

(wherein, [Mg] and [N] in formula (2') respectively represent the concentrations (wt %) of magnesium and nitrogen derived from an ashless dispersant in the lubricating oil composition). Cleaning performance of the lubricating oil composition can be ensured while lowering the frequency of occurrence of LSPI by enabling the value of Y' determined in the aforementioned equation (2') to satisfy the expression Y'0.18.

In addition, the aforementioned equation (2') becomes as shown with the following equation (2") in the case the lubricating oil composition contains calcium but does not contain magnesium:

$$Y''=[Ca]+[N] \quad (2'')$$

(wherein, [Ca] and [N] in formula (2") respectively represent the concentrations (wt %) of calcium and nitrogen derived from an ashless dispersant in the lubricating oil composition). Cleaning performance of the lubricating oil composition can be ensured while lowering the frequency of occurrence of LSPI by enabling the value of Y" determined in the aforementioned equation (2") to satisfy the expression Y"≥0.18.

In the aforementioned first invention, the lubricating oil composition is preferably such that Z indicated in the following equation (3) satisfies the expression Z=0.3 to 1.5 in addition to the aforementioned equations (1) and (2).

$$Z=[N]/([Ca]+[Mg]) \quad (3)$$

Z is preferably 0.35 to 1.3. In the aforementioned equation, [Ca], [Mg] and [N] respectively represent the contents (wt %) of calcium, magnesium and nitrogen derived from an ashless dispersant in the lubricating oil composition.

Z determined in the aforementioned equation (3) represents the preferable ratio between the amount of metal cleaner and the amount of ashless dispersant in the lubricating oil composition, the amounts of calcium and magnesium refer to the amount of metal cleaner in the lubricating oil composition, and the amount of nitrogen refers to the amount of ashless dispersant in the lubricating oil composition. The lubricating oil composition is able to acquire both the functions of oxidation stability and sludge dispersibility as a result of Z satisfying the aforementioned range. If the value of Z is less than the aforementioned lower limit value, there is the risk of the frequency of occurrence of LSPI being unable to be lowered or sludge dispersibility decreasing resulting in inadequate cleaning performance. In addition, if the value of Z exceeds the aforementioned upper limit value, there is the risk of being unable to ensure oxidation stability or poor cleaning performance. Although the first lubricating oil composition only requires that X indicated in the aforementioned equation (1) and Y indicated in the aforementioned equation (2) satisfy the aforementioned specified ranges, as a result of Z indicated in the aforementioned equation (3) further satisfying the previously described specific range, both prevention of the occurrence of LSPI and the ensuring of cleaning performance can be realized more reliably.

The aforementioned equation (3) becomes as shown with the following equation (3') in the case the lubricating oil composition contains magnesium but does not contain calcium:

$$Z'=[N]/[Mg] \quad (3')$$

Z' determined in the aforementioned equation (3') preferably satisfies the range of 0.3 to 1.5.

The aforementioned equation (3') becomes as shown with the following equation (3") in the case the lubricating oil composition contains calcium but does not contain magnesium:

$$Z''=[N]/[Ca] \quad (3'')$$

Z" determined in the aforementioned equation (3") preferably satisfies the range of 0.3 to 1.5.

Moreover, in the aforementioned first invention, the amount (wt %) of molybdenum [Mo] contained in the lubricating oil composition is such that [Mo]≤0.1% by weight, more preferably such that [Mo]≤0.06% by weight and even more preferably such that [Mo]≤0.02% by weight. If the amount of molybdenum exceeds the aforementioned upper limit value, there is the risk of poor cleaning performance. There are no particular limitations on the lower limit value of the amount of molybdenum. The amount of molybdenum may be 0% by weight provided X of equation (1) satisfies the expression X≤−0.85.

Moreover, in the aforementioned first invention, the amount (wt %) of phosphorous [P] contained in the lubricating oil composition is such that [P]≤0.12% by weight, preferably such that [P]≤0.10% by weight, and most preferably such that [P]≤0.09% by weight. If the amount of phosphorous exceeds the aforementioned upper limit value, there is a risk of high-temperature cleaning performance becoming poor and having a detrimental effect on the exhaust gas post-treatment device, thereby making this undesirable. Although there are no particular limitations on the lower limit value of the amount of phosphorous, it is preferably such that [P]≥0.02% by weight, more preferably such that [P]≥0.04% by weight, and most preferably such that [P]≥0.06% by weight. There is the risk of poor wear resistance in the case the amount of phosphorous is less than the aforementioned lower limit value.

In the aforementioned first invention, there are no particular limitations on the contents of calcium and magnesium contained in the lubricating oil composition provided X indicated in the aforementioned equation (1) and Y indicated in the aforementioned equation (2), and more preferably Z indicated in the aforementioned equation (3), satisfy the aforementioned ranges. The amount (wt %) of calcium [Ca] and the amount (wt %) of magnesium [Mg] contained in the lubricating oil composition are preferably such that [Ca]+1.65[Mg]≥0.08% by weight, more preferably such that [Ca]+1.65[Mg]≥0.1% by weight, and most preferably such that [Ca]+1.65[Mg]≥0.12% by weight. There is the risk of poor high-temperature cleaning performance in the case the value of [Ca]+1.65[Mg] is less than the aforementioned lower limit value. The upper limit of [Ca]+1.65 [Mg] is preferably such that [Ca]+1.65 [Mg]≤0.5% by weight, more preferably such that [Ca]+1.65 [Mg]≤0.3% by weight, and most preferably such that [Ca]+1.65 [Mg] ≤0.25% by weight. The amount of sulfated ash increases resulting in a detrimental effect on the exhaust gas post-treatment device if the value of [Ca]+1.65[Mg] exceeds the aforementioned upper limit value.

In a second aspect thereof, the present invention provides a lubricating oil composition capable of lowering the frequency of occurrence of LSPI and ensuring rust prevention. In this second invention, the lubricating oil composition comprises a lubricating oil base oil and at least one type of compound having magnesium. The lubricating oil composition optionally comprises at least one type of compound having calcium. The second invention is characterized in that the concentrations (wt %) of magnesium and calcium contained in the lubricating oil composition satisfy a specific relational expression. Namely, in the lubricating oil composition, Q as determined from the following equation (4):

$$Q=[Ca]+0.05[Mg] \quad (4)$$

(wherein, [Ca] and [Mg] in equation (4) respectively represent the concentrations (wt %) of calcium and magnesium in the lubricating oil composition)

satisfies the expression $Q \leq 0.15$; and,

W as determined from the following equation (5):

$$W=[Ca]+1.65[Mg] \quad (5)$$

(wherein, [Ca] and [Mg] in equation (5) respectively represent the concentrations (wt %) of calcium and magnesium in the lubricating oil composition)

satisfies the expression $0.14 \leq W \leq 1.0$. The following provides a detailed explanation of equations (4) and (5).

The aforementioned equation (4) is an equation determined from the correlation between the frequency of occurrence of LSPI and the concentrations of magnesium and calcium in the lubricating oil composition. In the aforementioned equation (4), [Ca] and [Mg] are the contents (wt %) of magnesium and calcium in the lubricating oil composition. The range of Q is preferably less than 0.15, more preferably 0.14 or less, and most preferably 0.13 or less. The occurrence of LSPI can be effectively inhibited if the value of Q is equal to or less than the aforementioned upper limit value. Although there are no particular limitations on the lower limit value of Q, it is preferably 0.003 or more, more preferably 0.005 or more, even more preferably 0.01 or more and most preferably 0.06 or more. Rust prevention may become poor or cleaning performance may become poor if Q is below the aforementioned lower limit value. The coefficient of [Mg] in equation (4) is 0.05. This coefficient refers to the degree of contribution of magnesium to the frequency of occurrence of LSPI as compared with calcium.

The aforementioned equation (5) is an equation determined from the correlation between rust prevention and the concentrations of calcium and magnesium contained in the lubricating oil composition, and the lower limit value of W refers to the lower limit value of the amounts of calcium and magnesium for ensuring rust prevention. The lower limit value of W is preferably 0.15 or more and more preferably 0.16 or more. Although larger amounts of calcium and magnesium make it possible to ensure greater rust prevention, if the amounts thereof are excessively large, the amount of sulfated ash in the lubricating oil composition increases and has an effect on the exhaust gas post-treatment device. The upper limit value of W determined in the aforementioned equation (5) refers to the upper limit value of the amounts of calcium and magnesium for preventing the amount of sulfated ash from exceeding a prescribed value. The upper limit value of W is preferably 0.95 or lower, more preferably 0.9 or lower, most preferably 0.65 or lower, and particularly preferably 0.25 or lower.

The amount of sulfated ash contained in the lubricating oil composition is measured in compliance with JIS K-2272. The amount of sulfated ash contained in the lubricating oil composition is preferably 3% by weight or less, more preferably 2% by weight or less, particularly preferably 1.5% by weight or less, and most preferably 1.0% by weight or less.

The coefficient of [Mg] in the aforementioned equation (5) is 1.65. This coefficient refers to the degree of contribution of magnesium to rust prevention as compared with calcium. The rust prevention effect of a metal cleaner is proportional to the number of atoms (namely, the number of moles) of that element. Since the atomic weight of magnesium is 1/1.65 the atomic weight of calcium, this means that calcium demonstrates 1.65 times the rust prevention effect for the same mass.

In the aforementioned second invention, the particularly preferable range of the value of Q indicated in the aforementioned equation (4) is $0.6 \leq Q \leq 0.13$, while the particularly preferable range of the value of W indicated in the aforementioned equation (5) is $0.15 \leq W \leq 0.24$.

In the aforementioned second invention, there are no limitations on the amounts of calcium and magnesium contained in the lubricating oil composition in the aforementioned second invention provided Q determined in the aforementioned equation (4) and W determined in the aforementioned equation (5) satisfy the aforementioned ranges. In particular, the amount of calcium in the lubricating oil composition is 0% by weight to 0.15% by weight, preferably 0.02% by weight to 0.14% by weight, more preferably 0.05% by weight to 0.13% by weight, and most preferably 0.06% by weight to 0.12% by weight. The amount of magnesium in the lubricating oil composition is 0.01% by weight to 0.6% by weight, preferably 0.02% by weight to 0.5% by weight, more preferably 0.05% by weight to 0.3% by weight, and most preferably 0.09% by weight to 0.2% by weight.

In the aforementioned second invention, the lubricating oil composition is not required to contain a compound having calcium. The aforementioned equation (4) becomes as shown with the following equation (4') in the case the lubricating oil composition does not contain a compound having calcium:

$$Q'=0.05[Mg] \quad (4')$$

the aforementioned equation (5) becomes as shown with the following equation (5'):

$$W'=1.65[Mg] \quad (5')$$

and the amount of magnesium [Mg] (wt %) contained in the lubricating oil composition is an amount such that the value of the aforementioned Q' satisfies the expression $Q' \leq 0.15$ and the value of the aforementioned W' satisfies the expression $0.14 \leq W' \leq 1.0$. Namely, this is an amount such that $0.08 \leq [Mg] \leq 0.6$ and preferably an amount such that $0.1 \leq [Mg] \leq 0.25$.

In the aforementioned second invention, the lubricating oil composition may contain a compound having molybdenum, a compound having phosphorous and an ashless dispersant having nitrogen. There are no particular limitations on the amounts of phosphorous, molybdenum and nitrogen contained in the lubricating oil composition.

In the aforementioned second invention, although there are no limitations thereon, the amount of molybdenum (wt %) [Mo] contained in the lubricating oil composition is preferably such that $[Mo] \leq 0.1\%$ by weight, more preferably such that $[Mo] \leq 0.08\%$ by weight, most preferably such that $[Mo] \leq 0.06\%$ by weight, and even more preferably such that $[Mo] \leq 0.02\%$ by weight. The lower limit value of the amount of molybdenum may be 0% by weight.

In the aforementioned second invention, the amount of phosphorous (wt %) [P] contained in the lubricating oil composition is preferably such that $[P] \leq 0.12\%$ by weight, more preferably such that $[P] \leq 0.10\%$ by weight, and most preferably such that $[P] \leq 0.09\%$ by weight, and although there are no limitations on the lower limit thereof, the lower limit value is preferably such that $[P] \geq 0.02\%$ by weight, more preferably such that $[P] \geq 0.04\%$ by weight, and most preferably such that $[P] \geq 0.06\%$ by weight. The amount of phosphorous [P] is particularly preferably such that 0.06% by weight $\leq [P] \leq 0.08\%$ by weight.

The lubricating oil composition of the aforementioned second invention is a lubricating oil composition comprising a lubricating oil base oil, a compound having magnesium, a compound having at least one type of element selected from molybdenum and phosphorous, and optionally, a compound having calcium, wherein the value of Q determined in the aforementioned equation (4) is within a range that satisfies the expression $Q \leq 0.15$, the value of W determined in the aforementioned equation (5) is within a range that satisfies the expression $0.14 \leq W \leq 1.0$, and the value of X determined in the aforementioned equation (1) is within a range that ranges of Q, W and X are as previously described.

In addition, the lubricating oil composition of the aforementioned second invention is a lubricating oil composition comprising a lubricating oil base oil, a compound having magnesium, a compound having at least one type of element selected from molybdenum and phosphorous, and optionally, a compound having calcium, wherein the value of Q determined in the aforementioned equation (4) is within a range that satisfies the expression $Q \leq 0.15$, the value of W determined in the aforementioned equation (5) is within a range that satisfies the expression $0.14 \leq W \leq 1.0$, and the value of X determined in the aforementioned equation (1) is within a range that satisfies the expression $X > -0.85$. The preferable ranges of Q, W and X are as previously described.

In the aforementioned second invention, there are no particular limitations on the amount of nitrogen contained in the lubricating oil composition. Here, the amount of nitrogen contained in the lubricating oil composition refers to the amount of ashless dispersant in the lubricating oil composition. The value of Z indicated with the aforementioned equation (3): $Z=[N]/([Ca]+[Mg])$ is an amount that satisfies the equation $Z=0.3$ to 1.5 and preferably $Z=0.35$ to 1.3 or less. In the aforementioned equation, [Ca], [Mg] and [N] are the contents (wt %) of calcium and magnesium in the lubricating oil composition and the content of nitrogen derived from the ashless dispersant.

The present invention further provides a lubricating oil composition comprising a lubricating oil base oil, at least one type of compound having magnesium, a compound having at least one type of element selected from molybdenum and phosphorous, an ashless dispersant having nitrogen, and optionally, at least one type of compound having calcium, wherein the value of X determined in the aforementioned formula (1) satisfies the expression $X \leq -0.85$, the value of Y determined in the aforementioned formula (2) satisfies the expression $Y \geq 0.18$, the value of Q determined in the aforementioned equation (4) satisfies the expression $Q \leq 0.15$, and the value of W determined in the aforementioned equation (5) satisfies the expression $0.14 \leq W \leq 1.0$. Such a lubricating oil composition is able to lower the frequency of occurrence of LSPI, ensure cleaning performance and ensure rust prevention.

[Lubricating Oil Base Oil]

The lubricating oil base oil in the aforementioned present invention may be a mineral oil or synthetic oil, and these can be used alone or can be used after mixing. Examples of mineral oils include that obtained by subjecting atmospheric residue obtained by atmospheric distillation of crude oil to vacuum distillation, and refining the resulting lubricating oil fraction by subjecting to one or more treatments such as solvent deasphalting, solvent extraction, hydrocracking, solvent dewaxing or hydrorefining, as well as wax-isomerized mineral oil, gas-to-liquid (GTL) base oil, asphalt-to-liquid (ATL) base oil, vegetable oil-derived base oil and mixed base oils thereof.

Examples of synthetic oils include polybutene and hydrides thereof, poly-α-olefins such as 1-octene oligomer or 1-decene oligomer and hydrides thereof, monoesters such as 2-ethylhexyl laurate, 2-ethylhexyl palmitate or 2-ethylhexyl stearate, diesters such as ditridecyl glutarate, di-2-ethylhexyl adipate, diisodecyl adipate, ditridecyl adipate or di(2-ethylhexyl) sebacate, polyol esters such as neopentyl glycol di(n-octanoate), neopentyl glycol di(n-decanoate), trimethylolpropane tri(n-octanoate), trimethylolpropane tri(n-decanoate), pentaerythritol tetra(n-pentanoate), pentaerythritol tetra(n-hexanoate) and pentaerythritol tetra(2-ethylhexanoate), aromatic synthetic oils such as alkyl naphthalene, alkyl benzene or aromatic esters, and mixtures thereof.

Although there are no limitations thereon, the kinetic viscosity ($mm^2/s$) of the lubricating oil base oil at 100° C. is preferably 2 $mm^2/s$ to 15 $mm^2/s$, more preferably 3 $mm^2/s$ to 10 $mm^2/s$ and most preferably 3 $mm^2/s$ to 6 $mm^2/s$. As a result, a composition can be obtained that demonstrates adequate oil film formation, has superior lubricity, and exhibits even less evaporative loss.

Although there are no limitations thereon, the viscosity index (VI) of the lubricating oil base oil is preferably 100 or more, more preferably 120 or more and most preferably 130 or more. As a result, viscosity at low temperatures can be reduced while ensuring the formation of an oil film at high temperatures.

The kinetic viscosity ($mm^2/s$) of the lubricating oil base oil at 40° C. is a value that can be determined from the kinetic viscosity at 100° C. as previously described and the aforementioned viscosity index (VI).

The aforementioned first invention is a lubricating oil composition comprising the aforementioned lubricating oil base oil, a compound having at least one type of element selected from calcium and magnesium, a compound having at least one type of element selected from molybdenum and phosphorous, and an ashless dispersant having nitrogen. The aforementioned second invention is a lubricating oil composition comprising the aforementioned lubricating oil base oil, at least one type of compound having magnesium, and optionally, at least one type of compound having calcium. These compounds are imparted by incorporating the various types of additives explained below.

[Additives]

Known additives added to lubricating oil compositions can be used as additives. The lubricating oil composition of the present invention comprises at least one type of additive having at least one type of element selected from calcium and magnesium, and at least one type of additive having at least one type of element selected from molybdenum and phosphorous. Examples of these additives include metal cleaners, wear inhibitors and friction modifiers. In addition, the lubricating oil composition of the present invention contains an ashless dispersant having nitrogen as previously described. The following provides a detailed explanation of these additives.

[A] Metal Cleaner

Although there are no particular limitations thereon, the metal cleaner preferably consists of one or more types of metal cleaners having at least one type of element selected from calcium and magnesium.

A metal cleaner having calcium is preferably calcium sulfonate, calcium phenate or calcium salicylate. In addition, a calcium-based cleaner containing boron may also be used. One type of these metal cleaners may be used alone or two or more types may be used as a mixture. As a result of containing these metal cleaners, high-temperature cleaning performance and rust prevention required for use as lubricating oil can be ensured. In particular, the lubricating oil composition of the present invention preferably contains a metal cleaner having overbased calcium. As a result, acid neutralization required by lubricating oil can be ensured. Furthermore, in the case of using a metal cleaner having overbased calcium, a metal cleaner having neutral calcium may be used in combination therewith.

Although there are no limitations thereon, the total base number of the metal cleaner having calcium is preferably 20 mgKOH/g to 500 mgKOH/g, more preferably 50 mgKOH/g to 400 mgKOH/g and most preferably 100 mgKOH/g to 350 mgKOH/g. As a result, acid neutralization, high-temperature cleaning performance and rust prevention required by lubricating oil can be ensured. Furthermore, in the case of using a mixture of two or more types of metal cleaners, the base number obtained after mixing is preferably within the aforementioned ranges.

The calcium content in the metal cleaner is preferably 0.5% by weight to 20% by weight, more preferably 1% by weight to 16% by weight and most preferably 2% by weight to 14% by weight. As a result, desired effects can be obtained with a suitable added amount.

The metal cleaner having magnesium is preferably magnesium sulfonate, magnesium phenate or magnesium salicylate. One type of these metal cleaners may be used alone or two or more types may be used as a mixture. As a result of containing these metal cleaners, high-temperature cleaning performance and rust prevention required for use as a lubricating oil can be ensured. In addition, the metal cleaner having magnesium may also be used by mixing with the aforementioned metal cleaner having calcium.

In particular, a metal cleaner having overbased magnesium is preferably contained. As a result, acid neutralization required by lubricating oil can be ensured. Furthermore, in the case of using a metal cleaner having overbased magnesium, a metal cleaner having neutral magnesium or calcium may be mixed therewith.

Although there are no limitations thereon, the total base number of the metal cleaner having magnesium is preferably 20 mgKOH/g to 600 mgKOH/g, more preferably 50 mgKOH/g to 500 mgKOH/g and most preferably 100 mgKOH/g to 450 mgKOH/g. As a result, acid neutralization, high-temperature cleaning performance and rust prevention required by lubricating oil can be ensured. Furthermore, in the case of using a mixture of two or more types of metal cleaners, the base number obtained after mixing is preferably within the aforementioned ranges.

The magnesium content in the metal cleaner is preferably 0.5% by weight to 20% by weight, more preferably 1% by weight to 16% by weight and most preferably 2% by weight to 14% by weight. As a result, desired effects can be obtained with a suitable added amount.

The amount of metal cleaner in the lubricating oil composition is an amount such that the amounts of calcium and magnesium contained in the composition satisfy the previously described specific ranges.

Furthermore, in the present invention, a metal cleaner having sodium within a range that does not deviate from the gist of the present invention can be used as an optional component. The metal cleaner having sodium is preferably sodium sulfonate, sodium phenate or sodium salicylate. One type of these metal cleaners may be used alone or two or more types may be used as a mixture. As a result of containing these metal cleaners, high-temperature cleaning performance and rust prevention required for use as a lubricating oil can be ensured. The metal cleaner having sodium can be used as a mixture with the aforementioned metal cleaner having calcium and/or the metal cleaner having magnesium.

In particular, a metal cleaner having overbased sodium is preferably contained. As a result, acid neutralization required by lubricating oil can be ensured. Furthermore, in the case of using a metal cleaner having overbased sodium, a metal cleaner having neutral sodium, calcium or magnesium may be mixed therewith.

Although there are no limitations thereon, the total base number of the metal cleaner having sodium is preferably 20 mgKOH/g to 500 mgKOH/g, more preferably 50 mgKOH/g to 400 mgKOH/g and most preferably 100 mgKOH/g to 350 mgKOH/g. As a result, acid neutralization, high-temperature cleaning performance and rust prevention required by lubricating oil can be ensured. Furthermore, in the case of using a mixture of two or more types of metal cleaners, the base number obtained after mixing is preferably within the aforementioned ranges.

The sodium content in the metal cleaner is preferably 0.5% by weight to 20% by weight, more preferably 1% by weight to 16% by weight and most preferably 2% by weight to 14% by weight. As a result, desired effects can be obtained with a suitable added amount. In the case of using a metal cleaner having sodium, the amount thereof in the lubricating oil composition is 5% by weight or less and preferably 3% by weight or less.

[B] Wear Inhibitor

A conventionally known wear inhibitor can be used for the wear inhibitor. Among these, a wear inhibitor having phosphorous is preferable, and zinc dithiophosphate (ZnDTP or ZDDP) represented by the formula indicated below is particularly preferable.

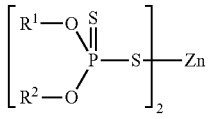

In the aforementioned formula, $R^1$ and $R^2$ may be mutually the same or different and respectively represent a hydrogen atom or monovalent hydrocarbon group having 1 to 26 carbon atoms. Examples of monovalent hydrocarbon groups include primary or secondary alkyl groups having 1 to 26 carbon atoms, alkenyl groups having 2 to 26 carbon atoms, cycloalkyl groups having 6 to 26 carbon atoms, and aryl groups, alkylaryl groups, arylalkyl groups and hydrocarbon groups containing an ester bond, ether bond, alcohol group or carboxyl group having 6 to 26 carbon atoms. $R^1$ and $R^2$ are preferably mutually the same or different and respectively represent a primary or secondary alkyl group having 2 to 12 carbon atoms, a cycloalkyl group having 8 to 18 carbon atoms or an alkylaryl group having 8 to 18 carbon atoms. Zinc dialkyldithiophosphate is particularly preferable, and the primary alkyl group preferably has 3 to 12 carbon atoms and more preferably 4 to 10 carbon atoms. The secondary alkyl group preferably has 3 to 12 carbon atoms and more preferably 3 to 10 carbon atoms. One type of the aforementioned zinc dithiophosphate may be used alone or two or more types may be used as a mixture. In addition, zinc dithiocarbamate (ZnDTC) may be used in combination therewith.

In addition, at least one type of compound selected from phosphate- and phosphite-type phosphorous compounds represented by the following formulas (6) and (7), along with metal salts and amine salts thereof, can also be used.

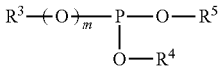

(6)

In the aforementioned general formula (6), $R^3$ represents a monovalent hydrocarbon group having 1 to 30 carbon atoms, $R^4$ and $R^5$ mutually independently represent a hydrogen atom or monovalent hydrocarbon group having 1 to 30 carbon atoms, and m represents 0 or 1.

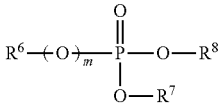

(7)

In the aforementioned general formula (7), $R^6$ represents a monovalent hydrocarbon group having 1 to 30 carbon atoms, $R^7$ and $R^8$ mutually independently represent a hydrogen atom or monovalent hydrocarbon group having 1 to 30 carbon atoms, and n represents 0 or 1.

In the aforementioned general formulas (6) and (7), examples of monovalent hydrocarbon groups having 1 to 30 carbon atoms represented by $R^3$ to $R^8$ include alkyl groups, cycloalkyl groups, alkenyl groups, alkyl-substituted cycloalkyl groups, aryl groups, alkyl-substituted aryl groups and arylalkyl groups. Alkyl groups having 1 to 30 carbon atoms or aryl groups having 6 to 24 carbon atoms are particularly preferable, alkyl groups having 3 to 18 carbon atoms are more preferable, and alkyl groups having 4 to 15 carbon atoms are most preferable.

Examples of phosphorous compounds represented by the aforementioned general formula (6) include phosphite monoesters and hydrocarbyl phosphites having one of the aforementioned hydrocarbon groups having 1 to 30 carbon atoms, phosphite diesters, monothiophosphite diesters and hydrocarbyl phosphite monoesters having two of the aforementioned hydrocarbon groups having 1 to 30 carbon atoms, phosphite triesters and hydrocarbyl phosphite diesters having three of the aforementioned hydrocarbon groups having 1 to 30 carbon atoms, and mixtures thereof.

Metal salts or amine salts of phosphorous compounds represented by the aforementioned general formulas (6) and (7) can be obtained by allowing a metal base such as a metal oxide, metal hydroxide, metal carbonate or metal chloride, or a nitrogen compound such as ammonia or amine compound having only a hydrocarbon group having 1 to 30 carbon atoms or hydroxyl group-containing hydrocarbon group in a molecule thereof, to act on a compound represented by general formula (6) or (7), followed by neutralizing all or a part of the remaining acidic hydrogen. Examples of metals in the aforementioned metal bases include alkaline metals such as lithium, sodium, potassium or cesium, alkaline earth metals such as calcium, magnesium or barium, and heavy metals such as zinc, copper, lead, nickel or manganese (excluding molybdenum). Among these, zinc and alkaline metals such as calcium or magnesium are preferable, and zinc is particularly preferable.

The amount of wear inhibitor in the lubricating oil composition is such that the amount of phosphorous contained in the composition is an amount that satisfies the previously described specific range. In the case of using a wear inhibitor that does not contain phosphorous such as zinc dithiocarbamate (ZnDTC), the amount contained in the lubricating oil composition is 0.1% by weight to 5.0% by weight and preferably 0.2% by weight to 3.0% by weight.

[C] Friction Modifier

A conventionally known friction modifier can be used for the friction modifier. Examples thereof include organic molybdenum compounds containing sulfur such as molybdenum dithiophosphate (MoDTP) and molybdenum dithiocarbamate (MoDTC), complexes of molybdenum compounds and sulfur-containing organic compounds or other organic compounds, and complexes of alkenyl succinic imides and sulfur-containing molybdenum compounds such as molybdenum sulfide or molybdate sulfide. Examples of the aforementioned molybdenum compounds include molybdenum oxides such as molybdenum dioxide or molybdenum trioxide, molybdic acids such as orthomolybdic acid, paramolybdic acid or (poly)molybdate sulfide, molybdates such as ammonium salts or metal salts of these molybdic acids, molybdenum sulfides such as molybdenum disulfide, molybdenum trisulfide, molybdenum pentasulfide or molybdenum polysulfide, molybdate sulfides, metal salts or amine salts of molybdate sulfides, and molybdenum halides such as molybdenum chloride. Examples of sulfur-containing organic comopunds include alkylthioxanthate, thiadiazole, mercaptothiadiazole, thiocarbonate, tetrahydrocarbylthiuram disulfide, bis(di(thio)hydrocarbyldithiophosphonate) disulfide, organic (poly)sulfides and sulfate esters. Organic molybdenum compounds such as molybdenum dithiophosphate (MoDTP) or molybdenum dithiocarbamate (MoDTC) are particularly preferable. These compounds having hydrocarbon groups having different numbers of carbon atoms and/or different structures in a molecule thereof can also be used.

Molybdenum dithiocarbamate (MoDTC) is a compound represented by the following formula [I], while molybdenum dithiophosphate (MoDTP) is a compound represented by the following formula [II].

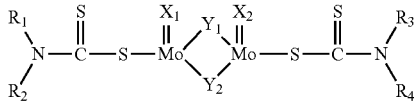

[I]

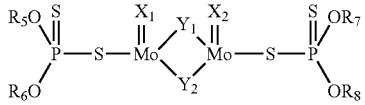

[II]

In the aforementioned general formulas [I] and [II], $R_1$ to $R_8$ may be mutually the same or different and respectively represent a monovalent hydrocarbon group having 1 to 30 carbon atoms. The hydrocarbon group may be linear or branched. Examples of the monovalent hydrocarbon groups include linear or branched alkyl groups having 1 to 30 carbon atoms, alkenyl groups having 2 to 30 carbon atoms, cycloalkyl groups having 4 to 30 carbon atoms, and aryl groups, alkylaryl groups or arylalkyl groups having 1 to 30 carbon atoms. The locations of bonds of the alkyl group in arylalky groups are arbitrary. More specifically, examples of alkyl groups include a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group and branched alkyl groups thereof, with alkyl groups having 3 to 8 carbon atoms being particularly preferable. In addition, $X_1$ and $X_2$ represent oxygen atoms or sulfur atoms, and $Y_1$ and $Y_2$ represent oxygen atoms or sulfur atoms.

An organic molybdenum compound not containing sulfur can also be used as a friction modifier in the present invention. Examples of these organic molybdenum compounds include molybdenum-amine complexes, molybdenum-succinic imide complexes, molybdenum salts of organic acids and molybdenum salts of alcohols. Among these, molybdenum-amine complexes, molybdenum salts of organic acids and molybdenum salts of alcohols are preferable.

Examples of molybdenum compounds that compose the aforementioned molybdenum-amine complexes include molybdenum compounds not containing sulfur such as molybdenum trioxide and hydrates thereof ($MoO_3.nH_2O$), molybdic acid ($H_2MoO_4$), alkaline metal salts of molybdic acid ($M_2MoO_4$, wherein M represents an alkaline metal), ammonium molybdate ($(NH_4)_2MoO_4$ or $(NH_4)6[Mo_7O_{24}].4H_2O$), $MoCl_5$, $MoOCl_4$, $MoO_2Cl_2$, $MoO_2Br_2$ or $Mo_2O_3Cl_6$. Among these molybdenum compounds, tetravalent molybdenum compounds are preferable from the viewpoint of the yield of a molybdenum-amine complex. Moreover, among hexavalent molybdenum compounds, molybdenum trioxide and hydrates thereof, molybdic acid, alkaline metal salts of molybdic acid and ammonium molybdate are preferable from the viewpoint of availability.

There are no particular limitations on the amine compound that composes the aforementioned molybdenum-amine complexes. Examples thereof include monoamines, diamines, polyamines and alkanolamines. More specifically, examples include alkylamines having alkyl groups having 1 to 30 carbon atoms (and these alkyl groups may be linear or branched), alkenylamines having alkenyl groups having 2 to 30 carbon atoms (and these alkenyl groups may be linear or branched), alkanolamines having alkanol groups having 1 to 30 carbon atoms (and these alkanol groups may be linear or branched), alkylene diamines having alkylene groups having 1 to 30 carbon atoms, polyamines such as diethylene triamine, triethylene tetramine, tetraethylene pentamine or pentaethylene hexamine, heterocyclic compounds such as imidazoline or compounds having alkyl groups or alkenyl groups having 8 to 20 carbon atoms on the aforementioned monoamines, diamines or polyamines, alkylene oxide adducts of these compounds, and mixtures thereof. Among these amine compounds, primary amines, secondary amines and alkanolamines are preferable.

The number of carbon atoms of the hydrocarbon group having an amine compound that composes the aforementioned molybdenum-amine complexes is preferably 4 or more, more preferably 4 to 30 and most preferably 8 to 18. If the number of carbon atoms of the hydrocarbon group of the amine compound is less than 4, solubility tends to be poor. In addition, as a result of making the number of carbon atoms of the amine compound to be 30 or less, the molybdenum content in the molybdenum-amine complex can be relatively enhanced, thereby making it possible to more greatly enhance the effects of the present invention while incorporating a smaller amount.

Examples of molybdenum-succinic imide complexes include complexes of a molybdenum compound not containing sulfur exemplified in the explanation of the aforementioned molybdenum-amine complex, and a succinic imide having an alkyl group or alkenyl group having 4 or more carbon atoms. Examples of succinic imides include succinic imides having at least one alkyl group or alkenyl group having 40 to 400 carbon atoms in a molecule thereof as described in the section on the ashless dispersant to be subsequently described, and succinic imides having an alkyl group or alkenyl group having 4 to 39 carbon atoms and preferably 8 to 18 carbon atoms. If the number of carbon atoms of the alkyl group or alkenyl groups in the succinic imide is less than 4, solubility tends to be poor. In addition, although it is possible to use a succinic imide having an alkyl group or alkenyl group having more than 30 to 400 carbon atoms, by making the number of carbon atoms of the alkyl group or alkenyl group to be 30 or less, the molybdenum content in the molybdenum-succinic imide complex can be relatively enhanced, thereby making it possible to more greatly enhance the effects of the present invention while incorporating a smaller amount.

Examples of molybdenum salts of organic acids include salts of molybdenum bases, such as the molybdenum oxides, molybdenum hydroxides, molybdenum carbonates or molybdenum chlorides exemplified in the explanation of the aforementioned molybdenum-amine complexes, and organic acids. The organic acids are preferably phosphorous compounds and carboxylic acids represented by the aforementioned general formulas (6) and (7). In addition, the carboxylic acid composing a molybdenum salt of a carboxylic acid may be a monobasic acid or polybasic acid.

A fatty acid normally having 2 to 30 carbon atoms and preferably having 4 to 24 carbon atoms is used as a monobasic acid, that fatty acid may be linear or branched, saturated or unsaturated, and examples thereof include saturated fatty acids and mixtures thereof. In addition, monocyclic or polycyclic carboxylic acids (which may or may not have a hydroxyl group) may be used in addition to the aforementioned fatty acids as monobasic acids, and the number of carbon atoms thereof is preferably 4 to 30 and more preferably 7 to 30. Examples of monocyclic or polycyclic carboxylic acids include aromatic carboxylic acids or cycloalkylcarboxylic acids having 0 to 3, and preferably 1 to 2, linear or branched alkyl groups having 1 to 30 carbon atoms and preferably 1 to 20 carbon atoms.

Examples of polybasic acids include dibasic acids, tribasic acids and tetrabasic acids. The polybasic acid may be a chain-like polybasic acid or cyclic polybasic acid. In addition, in the case of a chain-like polybasic acid, the polybasic acid may be linear or branched and may be saturated or unsaturated. Examples of chain-like polybasic acids preferably include chain-like dibasic acids having 2 to 16 carbon atoms.

Examples of molybdenum salts of alcohols include salts of the molybdenum compounds not containing sulfur exemplified in the explanation of the aforementioned molybdenum-amine complexes, and an alcohol. The alcohol may be a monovalent alcohol, polyvalent alcohol, partial ester or partially esterified compound of a polyvalent alcohol, or nitrogen compound having a hydroxyl group (such as an alkanolamine). Furthermore, although the molybdic acid is a strong acid that forms an ester by reacting with alcohol, esters of this molybdic acid and alcohol are included in the molybdenum salts of alcohols as referred to in the present invention. Examples of nitrogen compounds having a hydroxyl group include the alkanolamines exemplified in the explanation of the aforementioned molybdenun-amine complexes, and alkanolamides (such as diethanolamide) obtained by amidation of the amino group of the alkanol, and among these, stearyl diethanolamine, polyethylene glycol stearylamine, polyethylene glycol dioleylamine, hydroxyethyllaurylamine and diethanolamide oleate are preferable.

Moreover, the trinuclear molybdenum compound described in U.S. Pat. No. 5,906,968 can also be used for the friction modifier of the present invention.

The amount of friction modifier in the lubricating oil composition is such that the amount of molybdenum contained in the composition is an amount that satisfies the aforementioned specific range. In addition, in the case of using molybdenum dithiophosphate (MoDTP), the total amount of phosphorous contained in the lubricating oil composition is the amount that satisfies the aforementioned specific range.

[D] Ashless Dispersant

Cleaning performance can be ensured as a result of the lubricating oil composition of the present invention containing an ashless dispersant. Examples of ashless dispersants include nitrogen-containing compounds or derivatives thereof having in a molecule thereof at least one linear or branched alkyl group or alkenyl group having 40 to 500 carbon atoms and preferably 60 to 350 carbon atoms, Mannich dispersants, mono- or bis-succinic acid imides (such as alkenyl succinic acid imides), benzylamines having in a molecule thereof at least one alkyl group or alkenyl group having 40 to 500 carbon atoms, polyamines having in a molecule thereof at least one alkyl group or alkenyl group having 40 to 400 carbon atoms, boron compounds thereof, and modification products obtained with carboxylic acid or phosphoric acid. One type or two or more types thereof can be arbitrarily selected and incorporated. The present invention particularly preferably contains alkenyl succinic acid imide.

There are no particular limitations on the method used to produce the aforementioned succinic acid imide, and a compound having an alkyl group or alkenyl group having 40 to 500 carbon atoms can be obtained by reacting maleic anhydride at 100° C. to 200° C., and reacting the resulting alkyl succinic acid or alkenyl succinic acid with polyamine. Here, examples of polyamines include diethylenetriamine, triethylenetetramine, tetraethylenepentamine and pentaethylenehexamine. Examples of derivatives of nitrogen-containing compounds indicated as examples of the aforementioned ashless dispersant include so-called oxygen-containing organic compound-modified compounds obtained by neutralizing or amidating all or a portion of residual amino groups and/or imino groups after allowing a fatty acid or other monocarboxylic acid having 1 to 30 carbon atoms, oxalic acid, phthalic acid, trimellitic acid, pyromellitic acid or other polycarboxlic acid having 2 to 30 carbon atoms or an anhydride thereof, ester compound, alkylene oxide having 2 to 6 carbon atoms or hydroxy(poly) oxyalkylene carbonate to act on the previously described nitrogen-containing compounds, so-called boron-modified compounds obtained by neutralizing or amidating all or a portion of the residual amino groups and/or imino groups after allowing boron to act on the previously described nitrogen-containing compounds, so-called phosphoric acid-modified compounds obtained by neutralizing or amidating all or a portion of the residual amino groups and/or imino groups after allowing phosphoric acid to act on the previously described nitrogen-containing compounds, sulfur-modified compounds obtained by allowing a sulfur compound to act on the previously described nitrogen-containing compounds, and modified compounds combining two or more types of modifications of the previously described nitrogen-containing compounds selected from modification with an oxygen-containing organic compound, modification with boron, modification with phosphoric acid and modification with sulfur. Among these derivatives, boron-modified compounds of alkenyl succinic acid imides, and particularly bis-type boron-modified compounds of alkenyl succinic acid imides, are able to further improve heat resistance by using in combination with the previously described base oil.

The content ratio of the aforementioned ashless dispersant in the lubricating oil composition of the present invention in terms of the amount of nitrogen based on the total weight of the composition is normally 0.005% by weight to 0.4% by weight, preferably 0.01% by weight to 0.3% by weight, more preferably 0.01% by weight to 0.2% by weight and most preferably 0.02% by weight to 0.15% by weight. In addition, a boron-containing ashless dispersant can also be used for the ashless dispersant by mixing with an ashless dispersant not containing boron. In addition, in the case of using a boron-containing ashless dispersant, although there are no particular limitations on the content ratio thereof, the amount of boron contained in the composition based on the total weight of the composition is preferably 0.001% by weight to 0.1% by weight, more preferably 0.003% by weight to 0.05% by weight and most preferably 0.005% by weight to 0.04% by weight.

The number average molecular weight (Mn) of the ashless dispersant is preferably 2,000 or more, more preferably 2,500 or more, even more preferably 3,000 or more and most preferably 5,000 or more, and preferably 15,000 or less. If the number average molecular weight of the ashless dispersant is less than the aforementioned lower limit value, dispersibility may not be adequate. On the other hand, if the number average molecular weight of the ashless dispersant exceeds the aforementioned upper limit value, viscosity becomes excessively high and fluidity may be inadequate, thereby resulting in increased deposit levels.

[E] Viscosity Index Improver

A viscosity index improver is an example of an additive other than the aforementioned additives that can be contained in the lubricating oil composition of the present invention. Examples of viscosity index improvers include those containing polymethacrylate, dispersion-type polymethacrylate, olefin copolymers (polyisobutylene, ethylene-propylene copolymer), dispersion-type olefin copolymers, polyalkylstyrene, hydrogenated styrene-butadiene copolymer, styrene-maleic anhydride ester copolymer and star isoprene.

The viscosity index improver is normally composed of the aforementioned polymers and diluent oil. The content of viscosity index improver in the lubricating oil composition of the present invention based on the total weight of the composition as the amount of polymer is preferably 0.01% by weight to 20% by weight, more preferably 0.02% by weight to 10% by weight, and most preferably 0.05% by weight to 5% by weight. If the content of the viscosity index improver is lower than the aforementioned lower limit value, there is the risk of poor viscosity temperature characteristics and low-temperature viscosity characteristics. On the other hand, if the content of the viscosity index improver is greater than the aforementioned upper limit value, there is the risk of poor viscosity temperature characteristics and low-temperature viscosity characteristics, while further causing a considerable rise in product cost.

Other Additives

The lubricating oil composition of the present invention can further contain other additives corresponding to the specific objective in order to improve the performance thereof. Although additives commonly used in lubricating oil compositions can be used for those other additives, examples thereof include additives such as antioxidants, wear inhibitors (or extreme pressure agents) other than the aforementioned component [B], corrosion inhibitors, rust preventives, pour point depressants, demulsifiers, metal deactivators or antifoaming agents.

Examples of antioxidants include ashless antioxidants such as phenol-based or amine-based antioxidants, and metal-based antioxidants such as copper-based or molybdenum-based antioxidants. Examples of phenol-based ashless antioxidants include 4,4'-methylenebis(2,6-di-tert-butylphenol), 4,4'-bis(2,6-di-tert-butylphenol) and isooctyl-3-(3,5-di-tert-butyl-4-hydroxyphenyl)propionate, while examples of amine-based ashless dispersants include phenyl-α-naphthylamine, alkylphenyl-α-naphthylamine and dialkyldiphenylamine. Antioxidant is normally incorporated in the lubricating oil composition at 0.1% by weight to 5% by weight.

Arbitrary wear inhibitors or extreme pressure agents used in lubricating oil compositions can be used for the wear inhibitors (or extreme pressure agents) other than the aforementioned component [B]. For example, sulfur-based or sulfur-phosphorous-based extreme pressure agents can be used. More specifically, examples thereof include phosphite esters, thiophosphite esters, dithiophosphite esters, trithiophosphite esters, phosphate esters, thiophosphate esters, dithiophosphate esters, trithiophosphate esters, amine salts thereof, metal salts thereof, derivatives thereof, dithiocarbamates, zinc dithiocarbamate, molybdenum thiocarbamate, disulfides, polysulfides, olefin sulfides and sulfurized oils and fats. These wear inhibitors are normally incorporated in the lubricating oil composition at 0.1% by weight to 5% by weight.

Examples of corrosion inhibitors include benzotriazole-based, tolyltriazole-based, thiadiazole-based and imidazole-based compounds. Examples of the aforementioned rust preventives include petroleum sulfonate, alkylbenzene sulfonate, dinonylnaphthalene sulfonate, alkenyl succinate esters and polyvalent alcohol esters. The corrosion inhibitor is normally incorporated in the lubricating oil composition at 0.01% by weight to 3% by weight.

A polymethacrylate-based polymer compatible with the lubricating oil base oil used, for example, can be used for the pour point depressant. The pour point depressant is normally incorporated in the lubricating oil composition at 0.01% by weight to 3% by weight.

Examples of demulsifiers include polyalkylene glycol-based nonionic surfactants such as polyoxyethylene alkyl ethers, polyoxyethylene alkylphenyl ethers or polyoxyethylene alkylnaphthyl ethers. The demulsifier is normally incorporated in the lubricating oil composition at 0.01% by weight to 5% by weight.

Examples of metal deactivators include imidazoline, pyrimidine derivatives, alkylthiodiazoles, mercaptobenzothiazole, benzotriazole and derivatives thereof, 1,3,4-thiadiazole polysulfide, 1,3,4-thiadiazole-2,5-bisdialkyldithiocarbamate, 2-(alkyldithio)benzoimidazole and β-(o-carboxybenzylthio)propionitrile. The metal deactivator is normally incorporated in the lubricating oil composition at 0.01% by weight to 3% by weight.

Examples of antifoaming agents include silicone oil having kinetic viscosity at 25° C. of 1000 $mm^2/s$ to 100,000 $mm^2/s$, alkenyl succinic acid derivatives, esters of aliphatic polyhydroxy alcohols and long-chain fatty acids, methyl salicylate and o-hydroxybenzyl alcohol. The antifoaming agent is normally incorporated in the lubricating oil composition at 0.001% by weight to 1% by weight.

EXAMPLES

Although the following provides a more detailed explanation of the present invention by indicating examples and comparative examples, the present invention is not limited to the following examples.

Preparation of Lubricating Oil Composition

Lubricating Oil Compositions Nos. 1 to 29 were prepared by mixing each of the components indicated below in the compositions described in Tables 1 to 3 (expressed as percent by weight based on total weight (100% by weight) of all components).

[Lubricating Oil Base Oil]

The amount of base oil is the amount that brings the total weight of the lubricating oil composition to 100% by weight by addition of the base oil (balance).

Base Oil 1: Hydrocracked base oil (mineral oil), viscosity index: 125, 100° C. kinetic viscosity: 4 $mm^2/s$ Base Oil 2: Hydrocracked base oil (mineral oil), viscosity index: 135, 100° C. kinetic viscosity: 4 $mm^2/s$ Base Oil 3: Mixture of hydrocracked base oil (mineral oil) and poly-α-olefin, viscosity index: 125, 100° C. kinetic viscosity: 4 $mm^2/s$

[Additives]

[A] Metal Cleaner

Metal cleaner was incorporated such that the amounts of calcium and magnesium contained in the lubricating oil composition were the amounts described in Tables 1 to 3.

Metal Cleaner 1: Calcium sulfonate (total base number: 300 mgKOH/g, calcium content: 12% by weight)

Metal Cleaner 2: Calcium salicylate (total base number: 350 mgKOH/g, calcium content: 13% by weight)

Metal Cleaner 3: Calcium salicylate (total base number: 60 mgKOH/g, calcium content: 2% by weight)

Metal Cleaner 4: Magnesium sulfonate (total base number: 400 mgKOH/g, magnesium content: 9% by weight)

Metal Cleaner 5: Calcium phenate (total base number: 260 mgKOH/g, calcium content: 9% by weight)

Metal Cleaner 6: Magnesium salicylate (total base number: 340 mgKOH/g, magnesium content: 8% by weight)

[B] Wear Inhibitor

Wear inhibitor was incorporated such that the amount of phosphorous in the lubricating oil composition was the amount described in Tables 1 to 3.

Wear Inhibitor 1: sec-ZnDTP (secondary alkyl type, C3, C6, P content: 8% by weight)

Wear Inhibitor 2: Mixture of pri-ZnDTP (primary alkyl type, C8) and sec-ZnDTP (secondary alkyl type, C3, C6) (P content: 8% by weight)

[C] Friction Modifier

Friction modifier was incorporated such that the amount of molybdenum contained in the lubricating oil composition was the amount described in Tables 1 to 3.

Friction Modifier 1: MoDTC (Mo content: 10% by weight, S content: 11% by weight)

Friction Modifier 2: Alkylthiocarbamide molybdenum complex (Mo content: 6% by weight, S content: 10% by weight)

[D] Ashless Dispersant

Ashless dispersant was incorporated such that the amount of nitrogen contained in the lubricating oil composition was the amount described in Tables 1 to 3.

Ashless Dispersant 1: Boron-modified polyisobutenyl succinic acid imide (nitrogen content: 1.7% by weight, boron content: 0.4% by weight, number average molecular weight (Mn) of ashless dispersant: 6,000)

Ashless Dispersant 2: Non-boron-modified polyisobutenyl succinic acid imide (nitrogen content: 1.2% by weight, number average molecular weight (Mn) of ashless dispersant: 6,000)

Ashless Dispersant 3: Boron-modified polyisobutenyl succinic acid imide (nitrogen content: 2.1% by weight, boron content: 0.02% by weight, number average molecular weight (Mn) of ashless dispersant: 3,000)

[E] Viscosity Index Improver

Viscosity index improver was incorporated such that the amount of the following polymers contained in the lubricating oil composition was the amount described in Tables 1 to 3.

Viscosity Index Improver 1: Olefin copolymer (Mw: 200,000) content: 10% by weight Viscosity Index Improver 2: Polymethacrylate (Mn: 300,000) content: 20% by weight

[Other Additives]

Package containing antioxidant, antifoaming agent and pour point depressant.

TABLE 1

| | | | Lubricating Oil Composition No. | | | | | | | | | |
|---|---|---|---|---|---|---|---|---|---|---|---|---|
| | Composition (wt %) | | 1 | 2 | 3 | 4 | 5 | 6 | 7 | 8 | 9 | 10 |
| Base Oil | Base Oil 1 | | | | | Balance | Balance | Balance | Balance | Balance | Balance | Balance |
| | Base Oil 2 | | Balance | | | | | | | | | |
| | Base Oil 3 | | | Balance | Balance | | | | | | | |
| [A] | Metal Cleaner 1 | Ca | | | | 0.12 | | | 0.02 | 0.06 | | 0.12 |
| | Metal Cleaner 2 | Ca | 0.11 | 0.12 | 0.17 | | | | | | | |
| | Metal Cleaner 3 | Ca | | | | | | | | 0.04 | | |
| | Metal Cleaner 4 | Mg | | | | | 0.11 | 0.18 | 0.10 | | | |
| | Metal Cleaner 5 | Ca | | | | | | | | | 0.12 | |
| [B] | Wear Inhibitor 1 | P | 0.08 | 0.08 | 0.08 | 0.08 | 0.08 | 0.08 | 0.08 | | 0.08 | 0.08 |
| | Wear Inhibitor 2 | P | | | | | | | | 0.07 | | |
| [C] | Friction Modifier 1 | Mo | | 0.04 | 0.04 | 0.02 | 0.02 | 0.02 | 0.02 | | 0.02 | 0.01 |
| | Friction Modifier 2 | Mo | 0.02 | | | | | | | 0.01 | | 0.01 |
| [D] | Ashless Dispersant 1 | N | 0.03 | 0.09 | 0.09 | | | | | | | |
| | Ashless Dispersant 2 | N | 0.09 | | | 0.07 | 0.07 | 0.07 | 0.08 | 0.05 | 0.07 | 0.07 |
| | Ashless Dispersant 3 | N | | | | | | | | 0.04 | | |
| [E] | Viscosity Index Improver 1 | Polymer | 1 | 1 | 1 | | | | | | | |
| | Viscosity Index Improver 2 | Polymer | | | | 2 | 2 | 2 | 2 | 2 | 2 | 2 |
| | Other Additives | | 2 | 2 | 2 | 2 | 2 | 2 | 2 | 2 | 2 | 2 |

TABLE 2

| | | | Lubricating Oil Composition No. | | | | | | | | | |
|---|---|---|---|---|---|---|---|---|---|---|---|---|
| | Composition (wt %) | | 11 | 12 | 13 | 14 | 15 | 16 | 17 | 18 | 19 | 20 |
| Base Oil | Base Oil 1 | | Balance | Balance | Balance | Balance | Balance | Balance | Balance | Balance | Balance | Balance |
| [A] | Metal Cleaner 1 | Ca | 0.11 | | 0.05 | 0.02 | 0.03 | 0.13 | 0.09 | 0.09 | 0.09 | 0.11 |
| | Metal Cleaner 2 | Ca | | | | | | | | | | |
| | Metal Cleaner 3 | Ca | | | | | | | | | | |
| | Metal Cleaner 4 | Mg | 0.07 | | 0.18 | 0.25 | 0.11 | 0.02 | | 0.02 | 0.06 | 0.06 |
| | Metal Cleaner 5 | Ca | | | | | | | | | | |
| | Metal Cleaner 6 | Mg | | 0.18 | | | 0.09 | | | | | |
| [B] | Wear Inhibitor 1 | P | 0.08 | 0.08 | 0.08 | 0.08 | 0.08 | 0.08 | 0.08 | 0.08 | 0.08 | 0.07 |
| | Wear Inhibitor 2 | P | | | | | | | | | | |
| [C] | Friction Modifier 1 | Mo | 0.01 | 0.01 | 0.02 | 0.02 | 0.02 | 0.02 | 0.02 | 0.02 | 0.02 | |
| | Friction Modifier 2 | Mo | 0.01 | 0.01 | | | | | | | | |
| [D] | Ashless Dispersant 2 | N | 0.07 | 0.07 | 0.07 | 0.07 | 0.07 | 0.07 | 0.07 | 0.07 | 0.07 | 0.07 |
| [E] | Viscosity Index Improver 2 | Polymer | 2 | 2 | 2 | 2 | 2 | 2 | 2 | 2 | 2 | 2 |
| | Other Additives | | 2 | 2 | 2 | 2 | 2 | 2 | 2 | 2 | 2 | 2 |

TABLE 3

| | | | Lubricating Oil Composition No. | | | | | | | | |
|---|---|---|---|---|---|---|---|---|---|---|---|
| | Composition (wt %) | | 21 | 22 | 23 | 24 | 25 | 26 | 27 | 28 | 29 |
| Base Oil | Base Oil 1 | | Balance | Balance | Balance | Balance | Balance | Balance | Balance | Balance | Balance |
| [A] | Metal Cleaner 1 | Ca | 0.18 | 0.07 | 0.07 | 0.02 | 0.18 | 0.18 | 0.16 | 0.16 | 0.06 |
| | Metal Cleaner 2 | Ca | 0.04 | 0.04 | 0.04 | 0.04 | | | | | |
| | Metal Cleaner 3 | Mg | | | | | | 0.30 | 0.70 | 0.06 | 0.02 |
| [B] | Wear Inhibitor 1 | P | | | | | 0.07 | 0.08 | 0.08 | 0.07 | 0.07 |
| | Wear Inhibitor 2 | P | 0.07 | 0.13 | 0.11 | 0.07 | | | | | |
| [C] | Friction Modifier 1 | Mo | | | | | 0.02 | 0.02 | 0.02 | | |
| | Friction Modifier 2 | Mo | 0.01 | 0.01 | 0.01 | 0.01 | | | | | |
| [D] | Ashless Dispersant 2 | N | 0.05 | 0.06 | 0.05 | 0.05 | 0.07 | 0.07 | 0.07 | 0.07 | 0.07 |
| [E] | Viscosity Index Improver 2 | Polymer | 2 | 2 | 2 | 2 | 2 | 2 | 2 | 2 | 2 |
| | Other Additives | | 2 | 2 | 2 | 2 | 2 | 2 | 2 | 2 | 2 |

First Invention

Examples 1 to 20 and Comparative Examples 1 to 9

The calcium concentration (wt %) [Ca], magnesium concentration (wt %) [Mg], molybdenum concentration (wt %) [Mo], phosphorous concentration (wt %) [P] and nitrogen concentration derived from ashless dispersant (wt %) [N] in the lubricating oil compositions of Lubricating Oil Compositions Nos. 1 to 29 obtained in the manner as previously described were applied to the following equations (1) to (3). The resulting values for X, Y and Z are indicated in Tables 4 to 6.

$$X=([Ca]+0.5[Mg])\times 8-[Mg]\times 8-[P]\times 30 \quad \text{Equation (1):}$$

$$Y=[Ca]+1.65[Mg]+[N] \quad \text{Equation (2):}$$

$$Z=[N]/([Ca]+[Mg]) \quad \text{Equation (3):}$$

Measurement of Low Speed Pre-Ignition (LSPI) Frequency

The number of occurrences of LSPI in one hour was measured for each of the Lubricating Oil Compositions Nos. 1 to 29 using an inline 4-cylinder, supercharged, direct fuel-injected gasoline engine, and using a combustion pressure sensor attached to each cylinder under conditions of an engine speed of 1800 rpm and a fully-open throttle. The frequency of occurrence of LSPI (relative value) as calculated based on a value of 1.0 (reference) for the number of occurrences of LSPI in the case of the lubricating oil composition (No. 21) of Comparative Example 1 was indicated in Tables 4 to 6. Those compositions for which the frequency of occurrence of LSPI was one-third or less that of the reference composition (Comparative Example 1) were evaluated as acceptable (pass). The results are shown in Tables 4 to 6.

Hot Tube Test (Evaluation of High-Temperature Cleaning Performance)

Each of the Lubricating Oil Compositions Nos. 1 to 29 was subjected to a hot tube test in compliance with JPI-55-55-99. The following provides a description of details of the test method.

A lubricating oil composition was continuously poured into a glass tube having an inner diameter of 2 mm at a rate of 0.3 ml/hr and air injection rate of 10 ml/sec for 16 hours while maintaining the temperature of the glass tube at 280° C. The lacquer that adhered to the inside of the tube was compared with a color chart, and the compositions were scored based on a value of 10 for transparency and a value of 0 for black color. A higher score indicates better high-temperature cleaning performance. A score of 3.5 or higher was evaluated as acceptable (pass). The results are shown in Tables 4 to 6.

TABLE 4

| | | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| | Composition No. | 1 | 2 | 3 | 4 | 5 | 6 | 7 | 8 | 9 | 10 |
| | Equation (1): X | −1.68 | −1.76 | −1.36 | −1.6 | −2.12 | −1.84 | −2.00 | −1.38 | −1.60 | −1.60 |
| | Equation (2): Y | 0.23 | 0.21 | 0.26 | 0.19 | 0.25 | 0.37 | 0.27 | 0.19 | 0.19 | 0.19 |
| | Equation (3): Z | 1.09 | 0.75 | 0.53 | 0.58 | 0.64 | 0.39 | 0.67 | 0.90 | 0.58 | 0.58 |
| Evaluation Results | LSPI frequency (relative value) | 0 | 0 | 0.1 | 0 | 0 | 0 | 0 | 0 | 0 | 0 |
| | LSPI evaluation | Pass | Pass | Pass | Pass | Pass | Pass | Pass | Pass | Pass | Pass |
| | Hot tube test | 7.0 | 7.5 | 7.5 | 4.0 | 6.5 | 7.5 | 6.5 | 3.5 | 4.0 | 5.0 |
| | Cleaning performance evaluation | Pass | Pass | Pass | Pass | Pass | Pass | Pass | Pass | Pass | Pass |

TABLE 5

| | | Ex. 11 | Ex. 12 | Ex. 13 | Ex. 14 | Ex. 15 | Ex. 16 | Ex. 17 | Ex. 18 | Ex. 19 | Ex. 20 |
|---|---|---|---|---|---|---|---|---|---|---|---|
| | Composition No. | 11 | 12 | 13 | 14 | 15 | 16 | 17 | 18 | 19 | 20 |
| | Equation (1): X | −1.40 | −1.84 | −1.44 | −1.40 | −1.52 | −1.44 | −1.84 | −1.76 | −1.60 | −0.98 |
| | Equation (2): Y | 0.30 | 0.37 | 0.42 | 0.51 | 0.43 | 0.23 | 0.18 | 0.19 | 0.26 | 0.28 |
| | Equation (3): Z | 0.39 | 0.39 | 0.30 | 0.30 | 0.30 | 0.47 | 1.00 | 0.64 | 0.47 | 0.41 |
| Evaluation Results | LSPI frequency (relative value) | 0 | 0 | 0 | 0 | 0 | 0.1 | 0 | 0 | 0 | 0.3 |
| | LSPI evaluation | Pass | Pass | Pass | Pass | Pass | Pass | Pass | Pass | Pass | Pass |
| | Hot tube test | 6.5 | 7.0 | 7.5 | 7.5 | 7.5 | 6.0 | 3.5 | 4.0 | 6.0 | 6.5 |
| | Cleaning performance evaluation | Pass | Pass | Pass | Pass | Pass | Pass | Pass | Pass | Pass | Pass |

TABLE 6

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|
| | Composition No. | 21 | 22 | 23 | 24 | 25 | 26 | 27 | 28 | 29 |
| | Equation (1): X | −0.42 | −3.10 | −2.50 | −1.70 | −0.82 | 0.08 | 1.52 | −0.58 | −1.54 |
| | Equation (2): Y | 0.27 | 0.17 | 0.16 | 0.11 | 0.25 | 0.75 | 1.39 | 0.33 | 0.16 |
| | Equation (3): Z | 0.23 | 0.55 | 0.45 | 0.83 | 0.39 | 0.15 | 0.08 | 0.32 | 0.88 |
| Evaluation Results | LSPI frequency (relative value) | 1.0 | 0 | 0 | 0 | 1.0 | 0.6 | 0.4 | 0.8 | 0 |
| | LSPI evaluation | Fail | Pass | Pass | Pass | Fail | Fail | Fail | Fail | Pass |
| | Hot tube test | 7.0 | 3.0 | 2.5 | 0.5 | 6.5 | 8.0 | 9.0 | 6.5 | 1.0 |
| | Cleaning performance evaluation | Pass | Fail | Fail | Fail | Pass | Pass | Pass | Pass | Fail |

As shown in Tables 4 and 5, the concentrations (wt %) of calcium, magnesium, phosphorous, molybdenum and nitrogen contained in the lubricating oil compositions of Lubricating Oil Compositions Nos. 1 to 20 satisfy the requirements of the aforementioned first invention. These lubricating oil compositions are able to lower the frequency of occurrence of LSPI and ensure cleaning performance, and particularly high-temperature cleaning performance. In contrast, as shown in Table 6, the Lubricating Oil Compositions Nos. 21 to 29 do not satisfy the requirements of the aforementioned first invention. These lubricating oil compositions are unable to realize both decreased frequency of occurrence of LSPI and ensuring of cleaning performance.

Second Invention

Preparation of Lubricating Oil Compositions 30 to 32

Lubricating Oil Compositions Nos. 30 to 32 were prepared by mixing the previously described base oils and additives in the compositions described in the following Table 7 (percent by weight based on a value of 100% by weight for the total weight of all components).

TABLE 7

| | Composition (wt %) | | Lubricating Oil Composition No. 30 | 31 | 32 |
|---|---|---|---|---|---|
| Base Oil | Base Oil 1 | | Balance | Balance | Balance |
| [A] | Metal Cleaner 2 | Ca | 0.08 | 0.02 | 0.10 |
| | Metal Cleaner 4 | Mg | 0.50 | 0.40 | 0.30 |
| [B] | Wear Inhibitor 1 | P | 0.08 | 0.08 | 0.08 |
| [C] | Friction Modifier 1 | Mo | 0.02 | 0.02 | 0.02 |
| [D] | Ashless Dispersant 2 | N | 0.07 | 0.07 | 0.07 |
| [E] | Viscosity Index Improver 2 | Polymer | 2 | 2 | 2 |
| | Other Additives | | 2 | 2 | 2 |

Examples 21 to 34, Comparative Examples 10 to 18, Reference Examples 1 to 8

The concentration of calcium (wt %) [Ca] and the concentration of magnesium (wt %) [Mg] in the lubricating oil compositions of the Lubricating Oil Compositions Nos. 1 to 23 prepared as previously described were applied to the following equations (4) and (5). The resulting values of Q and W are indicated in Tables 8 to 10 and Tables 12 and 13.

$$Q=[Ca]+0.05[Mg] \quad \text{Equation 4:}$$

$$W=[Ca]+1.65[Mg] \quad \text{Equation 5:}$$

Evaluation of Rust Prevention

Lubricating Oil Compositions Nos. 1 to 23 were evaluated for rust prevention by carrying out the Ball Rust Test (BRT) in compliance with ASTM-D6557. A higher average gray value obtained by measurement indicates less formation of rust. A resulting average gray value of 100 or higher was evaluated as acceptable (pass). The results are shown in Tables 8 to 10 and Tables 12 and 13.

Measurement of Amount of Sulfated Ash

The amount of sulfated ash (wt) was measured for each of the Lubricating Oil Compositions Nos. 1 to 32 in compliance with JIS K 2272 entitled "Crude oil and petroleum products—Determination of ash and sulfated ash". A value for the amount of sulfated ash of 3% by weight or less was evaluated as acceptable (pass). The results are shown in Tables 8 to 10 and Tables 12 and 13.

Measurement of Low Speed Pre-Ignition (LSPI) Frequency and Hot Tube Test

Measurement of low speed pre-ignition (LSPI) frequency and a hot tube test were carried out on the Lubricating Oil Compositions Nos. 30 to 32 according to the previously described methods. The results are shown in Table 10.

TABLE 8

| | Ex. 21 | Ex. 22 | Ex. 23 | Ex. 24 | Ex. 25 | Ex. 26 |
|---|---|---|---|---|---|---|
| Composition No. | 5 | 6 | 7 | 11 | 12 | 13 |
| Equation (4): Q | 0.01 | 0.01 | 0.03 | 0.11 | 0.01 | 0.06 |
| Equation (5): W | 0.18 | 0.30 | 0.19 | 0.23 | 0.30 | 0.35 |

TABLE 8-continued

| | | Ex. 21 | Ex. 22 | Ex. 23 | Ex. 24 | Ex. 25 | Ex. 26 |
|---|---|---|---|---|---|---|---|
| Evaluation Results | LSPI Evaluation | Pass | Pass | Pass | Pass | Pass | Pass |
| | Rust Prevention Evaluation | Pass | Pass | Pass | Pass | Pass | Pass |
| | Sulfated Ash (wt %) | 0.8 | 1.0 | 0.7 | 0.9 | 1.0 | 1.2 |
| | Sulfated Ash Evaluation | Pass | Pass | Pass | Pass | Pass | Pass |

TABLE 9

| | | Ex. 27 | Ex. 28 | Ex. 29 | Ex. 30 | Ex. 31 |
|---|---|---|---|---|---|---|
| | Composition No. | 14 | 15 | 16 | 19 | 20 |
| | Equation (4): Q | 0.03 | 0.04 | 0.13 | 0.09 | 0.11 |
| | Equation (5): W | 0.43 | 0.36 | 0.16 | 0.19 | 0.21 |
| Evaluation Results | LSPI Evaluation | Pass | Pass | Pass | Pass | Pass |
| | Rust Prevention Evaluation | Pass | Pass | Pass | Pass | Pass |
| | Sulfated Ash (wt %) | 1.5 | 1.2 | 0.7 | 0.8 | 0.8 |
| | Sulfated Ash Evaluation | Pass | Pass | Pass | Pass | Pass |

TABLE 10

| | Composition No. | Ex. 32 30 | Ex. 33 31 | Ex. 34 32 |
|---|---|---|---|---|
| | Equation (4): Q | 0.11 | 0.04 | 0.12 |
| | Equation (5): W | 0.91 | 0.68 | 0.60 |
| Evaluation Results | LSPI Occurrence Frequency (relative value) | 0 | 0 | 0 |
| | LSPI Evaluation | Pass | Pass | Pass |
| | Rust Prevention Evaluation | Pass | Pass | Pass |
| | Sulfated Ash (wt %) | 3.0 | 2.3 | 2.0 |
| | Sulfated Ash Evaluation | Pass | Pass | Pass |
| | Hot Tube Test | 7.5 | 8.5 | 6.0 |
| | Cleaning Performance Evaluation | Pass | Pass | Pass |

As shown in Tables 8 to 10, the concentrations of magnesium and calcium (wt %) in the lubricating oil compositions of Lubricating Oil Compositions Nos. 5 to 7, 11 to 16, 19, 20 and 30 to 32 satisfy the requirements of the aforementioned second invention. These lubricating oil compositions are able to lower the frequency of occurrence of LSPI and ensure rust prevention.

Furthermore, as shown in the aforementioned Tables 4 and 5, the concentrations of calcium, magnesium, phosphorous, molybdenum and nitrogen (wt) contained in the lubricating oil compositions of Lubricating Oil Compositions Nos. 5 to 7, 11 to 16, 19 and 20 satisfy the requirements of the aforementioned first invention. Thus, these lubricating oil compositions are able to lower the frequency of occurrence of LSPI, ensure cleaning performance and ensure rust prevention. Namely, these lubricating oil compositions achieve the object of the second invention in addition to achieving the object of the first invention.

In addition, the concentration of calcium (wt %) [Ca], the concentration of magnesium (wt) [Mg], the concentration of molybdenum (wt %) [Mo], the concentration of phosphorous (wt %) [P], and the concentration of nitrogen derived from ashless dispersant (wt %) [N] in the lubricating oil compositions of Lubricating Oil Compositions Nos. 30 to 32 were applied to the aforementioned equations (1) to (3). The resulting values of X, Y and Z are shown in Table 11.

TABLE 11

| Composition No. | Example 32 30 | Example 33 31 | Example 34 32 |
|---|---|---|---|
| Equation (1): X | 0.08 | −0.80 | −0.56 |
| Equation (2): Y | 0.98 | 0.75 | 0.67 |
| Equation (3): Z | 0.12 | 0.17 | 0.18 |

As shown in Table 11, Lubricating Oil Compositions Nos. 30 to 32 are lubricating oil compositions in which the value of X determined in equation (1) is such that X>−0.85. Namely, these lubricating oil compositions do not satisfy the requirements of the aforementioned first invention. As shown in Table 10, since the concentrations (wt) of magnesium and calcium in these lubricating oil compositions satisfy the requirements of the aforementioned second invention, they are able to lower the frequency of occurrence of LSPI and ensure rust prevention.

TABLE 12

| | | Comp. Ex. 10 | Comp. Ex. 11 | Comp. Ex. 12 | Comp. Ex. 13 | Comp. Ex. 14 | Comp. Ex. 15 | Comp. Ex. 16 | Comp. Ex. 17 | Comp. Ex. 18 |
|---|---|---|---|---|---|---|---|---|---|---|
| | Composition No. | 21 | 22 | 23 | 24 | 25 | 26 | 27 | 28 | 29 |
| | Equation (4): Q | 0.22 | 0.11 | 0.11 | 0.06 | 0.18 | 0.20 | 0.20 | 0.16 | 0.06 |
| | Equation (5): W | 0.22 | 0.11 | 0.11 | 0.06 | 0.18 | 0.68 | 1.32 | 0.26 | 0.09 |
| Evaluation Results | LSPI Evaluation | Fail | Pass | Pass | Pass | Fail | Fail | Fail | Fail | Pass |
| | Rust Prevention Evaluation | Pass | Fail | Fail | Fail | Pass | Pass | Pass | Pass | Fail |
| | Sulfated Ash (wt %) | 0.9 | 0.5 | 0.5 | 0.4 | 0.8 | 2.3 | 4.8 | 1.0 | 0.5 |
| | Sulfated Ash Evaluation | Pass | Pass | Pass | Pass | Pass | Pass | Pass | Pass | Pass |

TABLE 13

| | | Ref. Ex. 1 | Ref. Ex. 2 | Ref. Ex. 3 | Ref. Ex. 4 | Ref. Ex. 5 | Ref. Ex. 6 | Ref. Ex. 7 | Ref. Ex. 8 |
|---|---|---|---|---|---|---|---|---|---|
| | Composition No. | 1 | 2 | 4 | 8 | 9 | 10 | 17 | 18 |
| | Equation (4): Q | 0.11 | 0.12 | 0.12 | 0.10 | 0.12 | 0.12 | 0.09 | 0.09 |
| | Equation (5): W | 0.11 | 0.12 | 0.12 | 0.10 | 0.12 | 0.12 | 0.09 | 0.12 |
| Evaluation Results | LSPI Evaluation | Pass | Pass | Pass | Pass | Pass | Pass | Pass | Pass |
| | Rust Prevention Evaluation | Fail | Fail | Fail | Fail | Fail | Fail | Fail | Fail |
| | Sulfated Ash (wt %) | 0.6 | 0.6 | 0.6 | 0.5 | 0.6 | 0.6 | 0.5 | 0.6 |
| | Sulfated Ash Evaluation | Pass | Pass | Pass | Pass | Pass | Pass | Pass | Pass |

As shown in Table 12, at least one of the values of Q indicated in the aforementioned equation (4) and W indicated in the aforementioned equation (5) for Lubricating Oil Compositions Nos. 21 to 29 does not satisfy the requirements of the second invention. These lubricating oil compositions are unable to realize both lowering of the frequency of occurrence of LSPI and ensuring rust prevention.

As shown in Tables 4 and 5, although Lubricating Oil Compositions Nos. 1, 2, 4, 8 to 10, 17 and 18 satisfy the requirements of the first invention, as shown in Table 13, they do not satisfy the requirements of the second invention. Although these lubricating oil compositions demonstrate a low frequency of occurrence of LSPI and favorable cleaning performance, they have inferior rust prevention. Namely, although the object of the first invention is achieved, the object of the second invention is not achieved.

Reference Examples 9 to 11

Lubricating Oil Composition Nos. 33 to 35 were prepared by mixing the aforementioned base oils and additives in the compositions (wt) shown in the following Table 14.

TABLE 14

| Composition (wt %) | | | Lubricating Oil Composition No. 33 | 34 | 35 |
|---|---|---|---|---|---|
| Base Oil | Base Oil 1 | | Balance | Balance | Balance |
| [A] | Metal Cleaner 1 | Ca | 0.06 | | 0.10 |
| | Metal Cleaner 4 | Mg | 0.70 | 1.00 | 0.80 |
| [B] | Wear Inhibitor 1 | P | 0.08 | 0.08 | 0.08 |
| [C] | Friction Modifier 1 | Mo | 0.02 | 0.02 | 0.02 |
| [D] | Ashless Dispersant 2 | N | 0.07 | 0.07 | 0.07 |
| [E] | Viscosity Index Improver 2 | Polymer | 2 | 2 | 2 |
| | Other Additives | | 2 | 2 | 2 |

The concentration of calcium (wt %) [Ca], the concentration of magnesium (wt %) [Mg], the concentration of phosphorous (wt %) [P], the concentration of molybdenum (wt %) [Mo] and the concentration of nitrogen (wt %) [N] in the lubricating oil compositions of the aforementioned Lubricating Oil Compositions Nos. 33 to 35 were applied to the previously described equations (1) to (5). The resulting values of X, Y, Z, Q and W are shown in the following Table 15. These lubricating oils were then subjected to measurement of low speed pre-ignition (LSPI) frequency, hot tube testing, evaluation of rust prevention and measurement of sulfated ash according to the previously described methods. The results are shown in Table 15 below.

TABLE 15

| | Composition No. | Ref. Ex. 9 33 | Ref. Ex. 10 34 | Ref. Ex. 11 35 |
|---|---|---|---|---|
| | Equation (1): X | 0.72 | 1.44 | 1.44 |
| | Equation (2): Y | 1.29 | 1.72 | 1.49 |
| | Equation (3): Z | 0.09 | 0.07 | 0.08 |
| | Equation (4): Q | 0.10 | 0.05 | 0.14 |
| | Equation (5): W | 1.22 | 1.65 | 1.42 |
| Evaluation Results | LSPI Frequency (relative value) | 0 | 0 | 0 |
| | LSPI Evaluation | Pass | Pass | Pass |
| | Hot Tube Test | 9.0 | 9.0 | 9.0 |
| | Cleaning Performance Evaluation | Pass | Pass | Pass |
| | Rust Prevention Evaluation | Pass | Pass | Pass |
| | Sulfated Ash (wt %) | 4.4 | 5.8 | 5.1 |
| | Sulfated Ash Evaluation | Fail | Fail | Fail |

As shown in Table 15, although Lubricating Oil Compositions Nos. 33 to 35 demonstrated a low frequency of occurrence of LSPI along with favorable cleaning performance and rust prevention, due to the excessively large amount of magnesium, the amount of sulfated ash in the lubricating oil composition exceeded the specified value. Thus, these lubricating oil compositions are not preferable for use as lubricating oil compositions.

INDUSTRIAL APPLICABILITY

A lubricating oil composition that satisfies the requirements of the aforementioned first invention is able to lower the frequency of occurrence of LSPI and ensure cleaning performance, and particularly high-temperature cleaning performance. In addition, a lubricating oil composition that satisfies the requirements of the aforementioned second invention is able to lower the frequency of occurrence of LSPI and ensure rust prevention. These lubricating oil compositions of the present invention can be preferably used as lubricating oil compositions for internal combustion engines, and particularly for supercharged gasoline engines.

The invention claimed is:

1. A lubricating oil composition adapted for use in a supercharged gasoline engine, comprising: a lubricating oil base oil, a compound having at least one element selected from calcium and magnesium, a compound having at least one element selected from molybdenum and phosphorous, and an ashless dispersant having nitrogen; wherein, X as determined from following equation (1):

$$X=([Ca]+0.5[Mg])\times 8-[Mo]\times 8-[P]\times 30 \quad (1)$$

wherein [Ca], [Mg], [Mo] and [P] in equation (1) respectively represent the concentrations (wt %) of calcium, magnesium, molybdenum and phosphorous in the lubricating oil composition, satisfies the expression $X\leq -1.68$;

Y as determined from following equation (2):

$$Y=[Ca]+1.65[Mg]+[N] \quad (2)$$

wherein [Ca], [Mg] and [N] in equation (2) respectively represent the concentrations (wt %) of calcium, magnesium and nitrogen derived from ashless dispersant in the lubricating oil composition, satisfies the expression $Y\geq 0.18$; and, Z as determined from following equation (3):

$$Z=[N]/([Ca]+[Mg]) \quad (3)$$

wherein [Ca], [Mg] and [N] respectively represent the concentrations (wt %) of calcium, magnesium and nitrogen derived from an ashless dispersant in the lubricating oil composition, further satisfies the expression $0.3\leq Z\leq 1.5$.

2. The lubricating oil composition according to claim 1, wherein the concentration of phosphorous [P] contained in the lubricating oil composition satisfies the expression $[P]\leq 0.12\%$ by weight.

3. The lubricating oil composition according to claim 1, wherein the concentration of molybdenum [Mo] contained in the lubricating oil composition satisfies the expression $[Mo]\leq 0.1\%$ by weight.

4. The lubricating oil composition according to claim 1, wherein the concentration of calcium [Ca] and the concentration of magnesium [Mg] contained in the lubricating oil composition satisfy the expression $[Ca]+1.65[Mg]\geq 0.08\%$ by weight.

5. The lubricating oil composition according to claim 1, wherein the lubricating base oil has a kinetic viscosity at 100° C. of 2 $mm^2/s$ to 15 $mm^2/s$.

6. The lubricating oil composition according to claim 1, containing at least one metal cleaner [A] having calcium or magnesium.

7. The lubricating oil composition according to claim 1, containing at least one wear inhibitor [B] having phosphorous.

8. The lubricating oil composition according to claim 1, containing at least one friction modifier [C] having molybdenum.

9. The lubricating oil composition according to claim 1, containing at least one viscosity index improver [E].

* * * * *